US011674416B2

(12) United States Patent
Matsunaga

(10) Patent No.: US 11,674,416 B2
(45) Date of Patent: Jun. 13, 2023

(54) VALVE TIMING REGULATOR

(71) Applicant: DENSO CORPORATION, Kariya (JP)

(72) Inventor: Yuki Matsunaga, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/183,701

(22) Filed: Feb. 24, 2021

(65) Prior Publication Data

US 2021/0180477 A1 Jun. 17, 2021

Related U.S. Application Data

(63) Continuation of application No. PCT/JP2019/034014, filed on Aug. 29, 2019.

(30) Foreign Application Priority Data

Aug. 31, 2018 (JP) ..... JP2018-162611

(51) Int. Cl.
*F01L 1/344* (2006.01)
*F01L 1/047* (2006.01)

(52) U.S. Cl.
CPC ..... *F01L 1/3442* (2013.01); *F01L 1/047* (2013.01)

(58) Field of Classification Search
USPC ..... 123/90.17, 90.15, 90.37
See application file for complete search history.

(56) References Cited

U.S. PATENT DOCUMENTS 5,729,899 A * 3/1998 Kaywood ..... F16D 1/072 29/523
8,166,937 B2 * 5/2012 Yamaguchi ..... F01L 1/3442 123/90.17
8,881,697 B2 * 11/2014 Noguchi ..... F01L 1/3442 123/90.17
2008/0173267 A1 * 7/2008 Takahashi ..... F01L 1/3442 123/90.17
2010/0175651 A1 * 7/2010 Takenaka ..... F01L 1/022 123/90.17
2012/0031359 A1 * 2/2012 Cuatt ..... F01L 1/3442 123/90.17
2013/0212880 A1 8/2013 Eimert
(Continued)

FOREIGN PATENT DOCUMENTS

DE 102015117797 A1 * 6/2016 ..... F01L 1/3442

OTHER PUBLICATIONS

DE-102015117797, Jun. 2016, English Langauge Machine Translation.*

(Continued)

*Primary Examiner* — Devon C Kramer
*Assistant Examiner* — Wesley G Harris
(74) *Attorney, Agent, or Firm* — Nixon & Vanderhye P.C.

(57) ABSTRACT

A friction shim is configured to generate a frictional force between a first shim contact surface of the friction shim and a shaft end surface of a driven shaft and a frictional force between a second shim contact surface of the friction shim and an opposing surface of a second rotatable body after installation of a valve timing regulator to the driven shaft. A contact member has a first member contact surface configured to contact the shaft end surface. The contact member is installed to the second rotatable body such that the first member contact surface contacts the shaft end surface before occurrence of contact of the first shim contact surface to the shaft end surface at a time of installing the valve timing regulator to the driven shaft.

16 Claims, 21 Drawing Sheets

(56) References Cited

U.S. PATENT DOCUMENTS

| | | | | |
|---|---|---|---|---|
| 2015/0034032 | A1* | 2/2015 | Ikuma | F01L 1/3442 123/90.15 |
| 2016/0010516 | A1* | 1/2016 | Suzuki | F03C 2/30 123/90.12 |

OTHER PUBLICATIONS

DE-102015117797-A1, English Language Machine Translation (Year: 2016).*

* cited by examiner

VALVE TIMING REGULATOR

CROSS REFERENCE TO RELATED APPLICATIONS

This application is a continuation application of International Patent Application No. PCT/JP2019/034014 filed on Aug. 29, 2019, which designated the U.S. and claims the benefit of priority from Japanese Patent Application No. 2018-162611 filed on Aug. 31, 2018. The entire disclosures of all of the above applications are incorporated herein by reference.

TECHNICAL FIELD

The present disclosure relates to a valve timing regulator.

BACKGROUND

There is known a valve timing regulator, in which a friction shim is placed between a driven shaft of an internal combustion engine and a second rotatable body of the valve timing regulator that is rotatable relative to a first rotatable body of the valve timing regulator.

SUMMARY

This section provides a general summary of the disclosure, and is not a comprehensive disclosure of its full scope or all of its features.

According to the present disclosure, there is provided a valve timing regulator that includes a first rotatable body, a second rotatable body, a friction shim and a contact member. The first rotatable body is configured to rotate synchronously with a drive shaft of an internal combustion engine. The second rotatable body has an opposing surface that is opposed to a shaft end surface, which is an end surface of a driven shaft. The friction shim is placed between the opposing surface and the shaft end surface and has a first shim contact surface, which is configured to contact the shaft end surface, and a second shim contact surface, which is configured to contact the opposing surface. According to one aspect, the contact member may have a first member contact surface configured to contact the shaft end surface, and the contact member may be installed to the second rotatable body or the first rotatable body such that the first member contact surface contacts the shaft end surface before occurrence of contact of the first shim contact surface to the shaft end surface or occurrence of contact of the second shim contact surface to the opposing surface at a time of installing the valve timing regulator to the driven shaft. According to another aspect, the contact member may have a first member contact surface, which is configured to contact the shaft end surface, and a second member contact surface, which is configured to contact the opposing surface, and the contact member may be installed to the driven shaft such that the second member contact surface contacts the opposing surface before occurrence of contact of the first shim contact surface to the shaft end surface or occurrence of contact of the second shim contact surface to the opposing surface at a time of installing the valve timing regulator to the driven shaft.

BRIEF DESCRIPTION OF DRAWINGS

The present disclosure, together with additional objectives, features and advantages thereof, will be best understood from the following description in view of the accompanying drawings.

DETAILED DESCRIPTION

Figure 1:
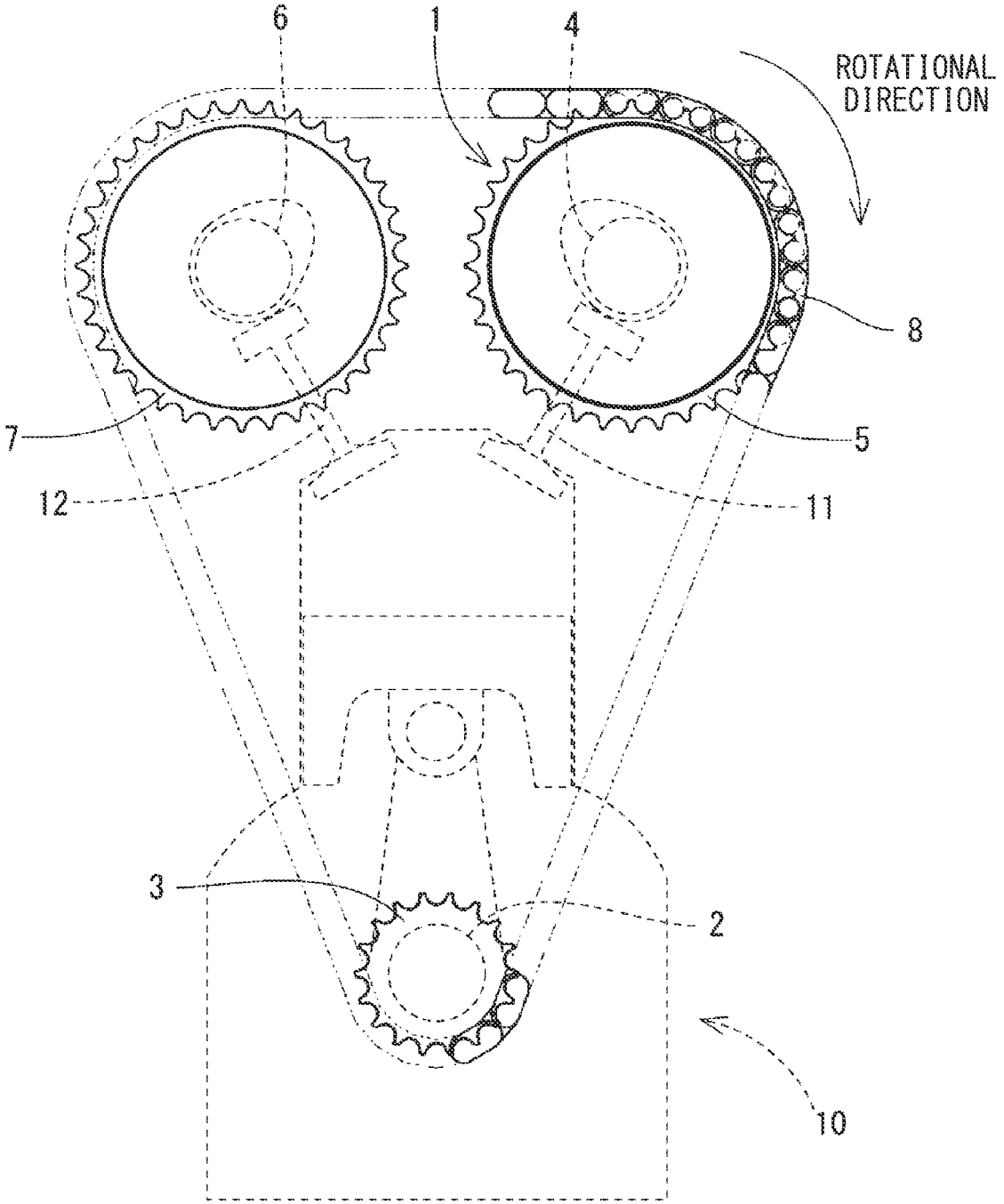
FIG. 1 is a schematic diagram showing a valve timing regulator according to a first embodiment and an internal combustion engine to which the valve timing regulator is applied.

There is known a valve timing regulator, in which a friction shim is placed between a driven shaft of an internal combustion engine and a second rotatable body of the valve timing regulator that is rotatable relative to a first rotatable body of the valve timing regulator. For example, in one previously proposed valve timing regulator, the friction shim is placed between an end surface of the driven shaft and an opposing surface of the second rotatable body that is opposed to the end surface of the driven shaft at the time of installing the valve timing regulator to the driven shaft. The friction shim generates a frictional force between the opposing surface of the second rotatable body and the end surface of the driven shaft after the installation of the valve timing regulator to the driven shaft. Thereby, it is possible to limit slippage that would be caused by relative rotation between the second rotatable body and the driven shaft.

In the previously proposed valve timing regulator discussed above, at the time of installing the valve timing regulator to the driven shaft, a relative position between the second rotatable body and the driven shaft is adjusted, and the second rotatable body is tightly coupled to the driven shaft by rotating a center bolt. Therefore, the friction shim and the end surface of the driven shaft may possibly slide relative to each other. Thereby, wear particles may possibly be generated between the friction shim and the driven shaft. Thus, the wear particles may be mixed into the hydraulic oil supplied to hydraulic chambers located between the first rotatable body and the second rotatable body to possibly cause malfunction of the valve timing regulator.

According to a first aspect of the present disclosure, there is provided a valve timing regulator configured to be installed to a driven shaft of an internal combustion engine and regulate valve timing of the internal combustion engine. The valve timing regulator includes a first rotatable body, a second rotatable body, a friction shim and a contact member.

The first rotatable body is configured to rotate synchronously with a drive shaft of the internal combustion engine. The second rotatable body has an opposing surface that is opposed to a shaft end surface, which is an end surface of the driven shaft. The second rotatable body forms a plurality of hydraulic pressure chambers between the first rotatable body and the second rotatable body. The second rotatable body is configured to be rotated together with the driven shaft relative to the first rotatable body by hydraulic oil supplied to corresponding one or more of the plurality of hydraulic pressure chambers. The friction shim is placed between the opposing surface and the shaft end surface and has a first shim contact surface, which is configured to contact the shaft end surface, and a second shim contact surface, which is configured to contact the opposing surface. The friction shim is configured to generate a frictional force between the first shim contact surface and the shaft end surface and a frictional force between the second shim contact surface and the opposing surface after installation of the valve timing regulator to the driven shaft. The contact member has a first member contact surface configured to contact the shaft end surface.

The contact member may be installed to the second rotatable body or the first rotatable body such that the first member contact surface contacts the shaft end surface before occurrence of contact of the first shim contact surface to the shaft end surface at a time of installing the valve timing regulator to the driven shaft. Therefore, at the time of installing the valve timing regulator to the driven shaft, even when the relative position between the second rotatable body and the driven shaft is adjusted, or when the second rotatable body is tightly coupled to the driven shaft by rotating the center bolt, the first shim contact surface of the friction shim and the shaft end surface do not slide relative to each other although the first member contact surface of the contact member and the shaft end surface slide relative to each other. Thereby, it is possible to limit generation of the wear particles between the friction shim and the driven shaft.

Furthermore, the contact member may be installed to the second rotatable body or the first rotatable body such that the first member contact surface contacts the shaft end surface before occurrence of contact of the second shim contact surface to the opposing surface at the time of installing the valve timing regulator to the driven shaft. In this case, at the time of installing the valve timing regulator to the driven shaft, even when the relative position between the second rotatable body and the driven shaft is adjusted, or when the second rotatable body is tightly coupled to the driven shaft by rotating the center bolt, the second shim contact surface of the friction shim and the opposing surface do not slide relative to each other although the first member contact surface of the contact member and the shaft end surface slide relative to each other. Thereby, it is possible to limit generation of the wear particles between the friction shim and the second rotatable body.

According to a second aspect of the present disclosure, the contact member has the first member contact surface, which is configured to contact the shaft end surface, and a second member contact surface, which is configured to contact the opposing surface.

The contact member may be installed to the driven shaft such that the second member contact surface contacts the opposing surface before occurrence of contact of the first shim contact surface to the shaft end surface at the time of installing the valve timing regulator to the driven shaft. Therefore, at the time of installing the valve timing regulator to the driven shaft, even when the relative position between the second rotatable body and the driven shaft is adjusted, or when the second rotatable body is tightly coupled to the driven shaft by rotating the center bolt, the first shim contact surface of the friction shim and the shaft end surface do not slide relative to each other although the second member contact surface of the contact member and the opposing surface slide relative to each other. Thereby, it is possible to limit generation of the wear particles between the friction shim and the driven shaft.

Furthermore, the contact member may be installed to the driven shaft such that the second member contact surface contacts the opposing surface before occurrence of contact of the second shim contact surface to the opposing surface at the time of installing the valve timing regulator to the driven shaft. In this case, at the time of installing the valve timing regulator to the driven shaft, even when the relative position between the second rotatable body and the driven shaft is adjusted, or when the second rotatable body is tightly coupled to the driven shaft by rotating the center bolt, the second shim contact surface of the friction shim and the opposing surface do not slide relative to each other although the second member contact surface of the contact member and the opposing surface slide relative to each other. Thereby, it is possible to limit generation of the wear particles between the friction shim and the second rotatable body.

As described above, according to the present disclosure, at the time of installing the valve timing regulator to the driven shaft, it is possible to limit the generation of the wear particles between the friction shim and the driven shaft or between the friction shim and the second rotatable body, and thereby it is possible to limit mixing of the wear particles, i.e., foreign objects into the hydraulic oil to be supplied to the hydraulic pressure chambers of the valve timing regulator. Thereby, the malfunction of the valve timing regulator can be limited.

Hereinafter, a valve timing regulator of a plurality of embodiments of the present disclosure will be described with reference to the drawings. In the following embodiments, the substantially same components are denoted by the same reference signs, and redundant description thereof will be omitted. Further, in the following embodiments, substantially the same constituent parts have the same or similar action and effect.

First Embodiment

Figure 2:
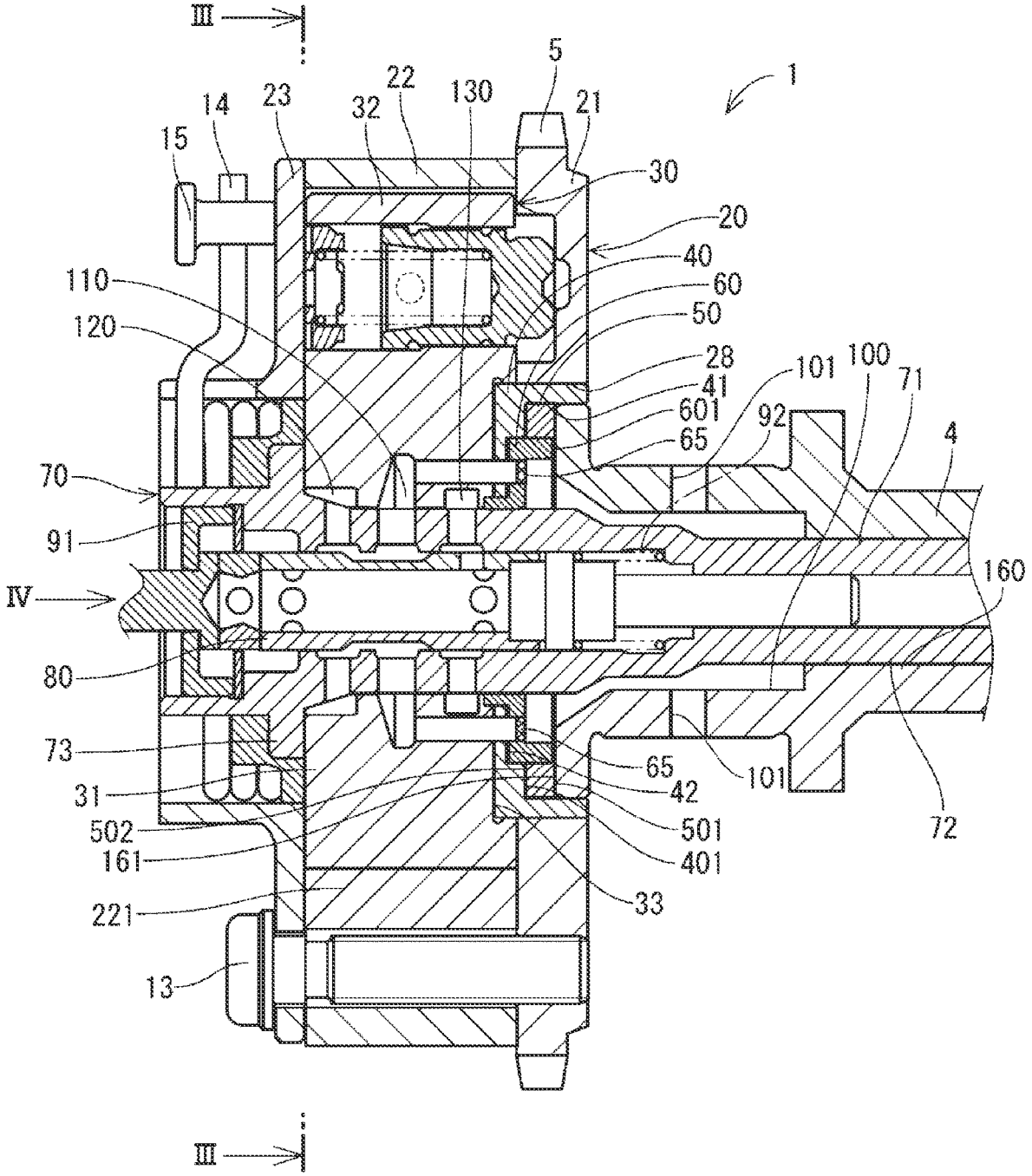
FIG. 2 is a cross-sectional view showing the valve timing regulator according to the first embodiment.

FIGS. 1 and 2 show a valve timing regulator of a first embodiment and an internal combustion engine, to which the valve timing regulator is installed. The valve timing regulator 1 regulates the valve timing of intake valves 11, which are opened and closed by a camshaft 4 of an engine 10 (serving as an internal combustion engine), by changing a rotational phase of the camshaft 4 relative to a crankshaft 2 of the engine 10. The valve timing regulator 1 is installed in a drive force transmission path, which extends form the crankshaft 2 to the camshaft 4. The crankshaft 2 serves as a drive shaft. The camshaft 4 serves as a driven shaft.

As shown in FIG. 1, in a drive force transmission system, in which the valve timing regulator 1 of the present embodiment is installed, a chain 8 is wound around: a chain sprocket 3, which is fixed to the crankshaft 2 of the engine 10; a gear 5, which is coaxial with the camshaft 4 serving as the driven shaft; and a chain sprocket 7, which is fixed to a camshaft 6, and a drive force is transmitted from the crankshaft 2 to the camshaft 4. The gear 5, which is described above, and a vane rotor 30, which will be described later, respectively form a part of the valve timing regulator 1.

The camshaft 4 opens and closes the intake valves 11, and the camshaft 6 opens and closes exhaust valves 12. The valve timing regulator 1 of the present embodiment is a hydraulic control type that uses hydraulic oil as hydraulic fluid. In the valve timing regulator 1, the gear 5 is coupled to the chain 8, and the vane rotor 30 is coupled to the camshaft 4, so that the valve timing regulator 1 regulates opening and closing timing of the intake valves 11.

Figure 3:
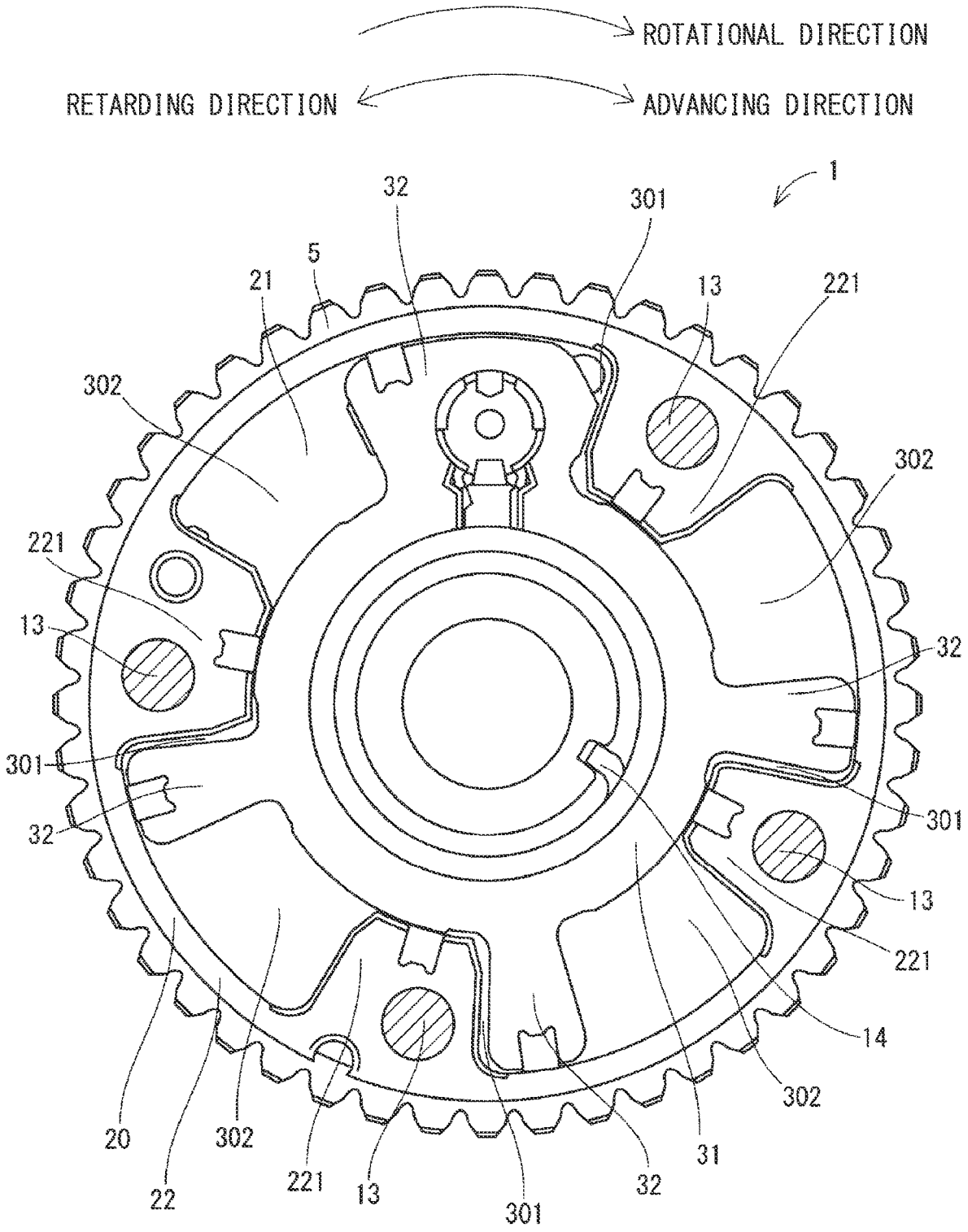
FIG. 3 is a cross-sectional view taken along line III-III in FIG. 2.
Figure 4:
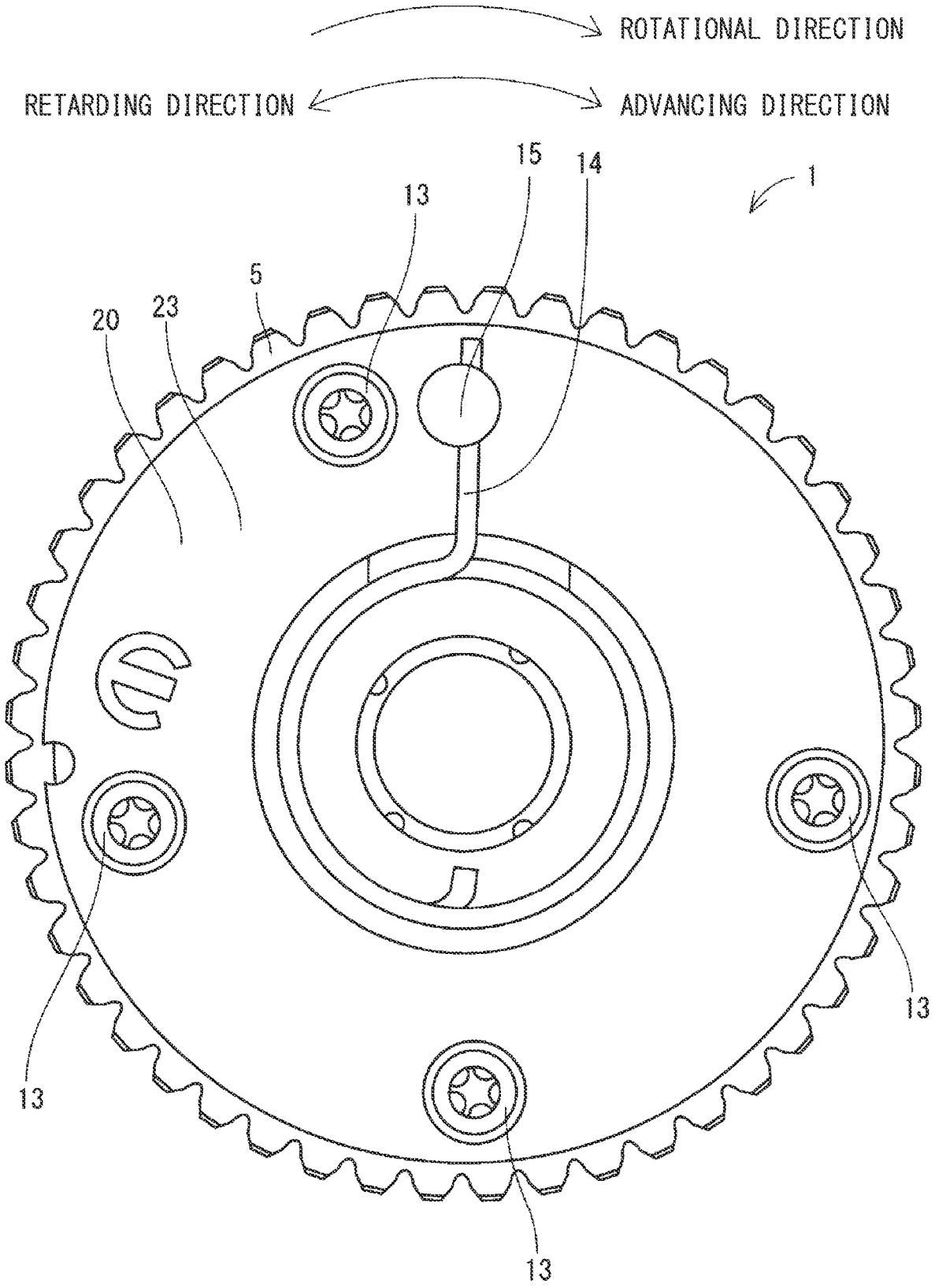
FIG. 4 is a view taken in a direction of an arrow IV in FIG. 2.

As shown in FIGS. 2 to 4, the valve timing regulator 1 includes: a housing 20, which serves as a first rotatable body; the vane rotor 30 and a rotor 40, which serve as a second rotatable body; a friction shim 50; a contact member 60; a center bolt 70; and a spool 80.

As shown in FIG. 2, the housing 20 includes a rear plate 21, a shoe housing 22 and a front plate 23, which are respectively formed as separate members. The rear plate 21, the shoe housing 22 and the front plate 23 are respectively made of metal, such as iron through, for example, a sintering process or a casting process. Each of bolts 13 is inserted through a corresponding bolt hole of the front plate 23 and a corresponding bolt hole of the shoe housing 22 and threadably fixed into a corresponding bolt hole of the rear plate 21. Thereby, the rear plate 21, the shoe housing 22 and the front plate 23 are coaxially fixed together.

The gear 5 is formed along an outer periphery of the rear plate 21. A through hole extends through a center of the rear plate 21 in a direction of a plate thickness (hereinafter referred to as a plate thickness direction) of the rear plate 21. Specifically, the rear plate 21 is shaped in a ring form. A through hole extends through a center of the front plate 23 in a plate thickness direction of the front plate 23. Specifically, the front plate 23 is shaped in a ring form.

As shown in FIG. 3, the shoe housing 22 has four shoes 221, which radially inwardly project from an inner peripheral wall of the shoe housing 22 configured generally into a cylindrical tubular form, while the shoes 221 are arranged at generally equal intervals in a circumferential direction.

The housing 20 receives the vane rotor 30 such that the vane rotor 30 is rotatable relative to the housing 20. The vane rotor 30 is fixed to the camshaft 4 and is rotated together with the camshaft 4. In a view taken in a direction of an arrow IV in FIG. 2, the housing 20, the vane rotor 30 and the camshaft 4 are rotated in a clockwise direction. Hereinafter, this rotational direction will be referred to as an advancing direction.

The vane rotor 30 made of metal such as, iron through, for example, a sintering process or a casting process. The vane rotor 30 has: a boss 31, which is shaped generally in a cylindrical tubular form and is received in the housing 20; and four vanes 32, which radially outwardly project from the boss 31. The boss 31 has a vane rotor recess 33. The vane rotor recess 33 is recessed from an end surface of the boss 31 located on the rear plate 21 side toward the front plate 23. An inner peripheral wall of the vane rotor recess 33 is shaped generally in a cylindrical tubular form.

An outer diameter of each vane 32 of the vane rotor 30 is set to be smaller than an inner diameter of the inner peripheral wall of the shoe housing 22. Furthermore, an outer diameter of the boss 31 of the vane rotor 30 is set to be small than an inner diameter of each shoe 221 of the shoe housing 22. With the above-describe configuration, a clearance is formed between the vane rotor 30 and the shoe housing 22.

Each vane 32 is placed between corresponding adjacent two of the shoes 221 such that a retard chamber 301 is formed between the vane 32 and one of the corresponding adjacent two of the shoes 221, and an advance chamber 302 is formed between the vane 32 and the other one of the corresponding adjacent two of the shoes 221. Specifically, the retard chambers 301 and the advance chambers 302, which serve as hydraulic pressure chambers, are formed between the vane rotor 30 and the housing 20.

An arrow, which indicates a retarding direction in FIG. 3, indicates a retarding direction of the vane rotor 30 relative to the housing 20, and an arrow, which indicates an advancing direction in FIG. 3, indicates an advancing direction of the vane rotor 30 relative to the housing 20. The camshaft 4 and the vane rotor 30 are coaxially rotatable relative to the housing 20. When a pressure of the respective retard chambers 301 becomes higher than a pressure of the respective advance chambers 302, the vane rotor 30 is rotated in the retarding direction relative to the housing 20. In contrast, when the pressure of the respective advance chambers 302 become higher than the pressure of the respective retard chambers 301, the vane rotor 30 is rotated in the advancing direction relative to the housing 20.

The rotor 40 is shaped generally in a circular plate form and is made of metal, such as iron. A through hole is formed at a center of the rotor 40 such that the through hole extends through the rotor 40 in a plate thickness direction of the rotor 40. The rotor 40 has a recess 41, a rotor recess 42 and an inner peripheral portion 43 (see FIGS. 6A, 6B and 6C). The recess 41 is shaped in a circular form and is recessed at a center of one surface of the rotor 40 toward the other surface of the rotor 40, which is opposed to the one surface of the rotor 40. A bottom surface of the recess 41 has an opposing surface 401 that is opposed to a shaft end surface 161, which is an end surface of the camshaft 4, at the time of installing the valve timing regulator 1 to the camshaft 4.

The rotor recess 42 is recessed at a center of the bottom surface of the recess 41 toward the other surface of the rotor 40. The inner peripheral portion 43 is shaped generally in a circular ring form such that the inner peripheral portion 43 joins between an inner peripheral portion of the bottom surface of the rotor recess 42 and an inner peripheral portion of the other surface of the rotor 40.

The rotor 40 is fitted into the vane rotor recess 33 such that the other surface of the rotor 40 is opposed to a bottom surface of the vane rotor recess 33. The vane rotor 30 and the rotor 40 are configured to rotate together and serve as the second rotatable body. The rear plate 21 has an inner peripheral portion 210, which is shaped generally in a circular ring form. An outer peripheral portion of the rotor 40 is slidable relative to the inner peripheral portion 210 of the rear plate 21.

The friction shim 50 is shaped generally in a circular ring form and is placed between the opposing surface 401 of the rotor 40 and the shaft end surface 161 of the camshaft 6. The friction shim 50 is configured to generate a frictional force between the friction shim 50 and the opposing surface 401 and a frictional force between the friction shim 50 and the shaft end surface 161 after installation of the valve timing regulator 1 to the camshaft 4. The contact member 60 is placed on an inner side of the rotor 40. The friction shim 50 and the contact member 60 will be described later.

The valve timing regulator 1 is fixed to the camshaft 4 with the center bolt 70. The center bolt 70 is made of, for example, metal and has a bolt main body 71, a bolt thread portion 72 and a bolt flange portion 73. The bolt main body 71 is shaped generally in a cylindrical tubular form. The bolt thread portion 72 is formed as a male thread at an outer peripheral wall of one end portion of the bolt main body 71. The bolt flange portion 73 is shaped generally in a circular ring form and radially outwardly projects from an outer peripheral wall of the other end portion of the bolt main body 71.

A shaft hole 100 is formed at the camshaft 4 such that the shaft hole 100 extends from the shaft end surface 161 in the axial direction. A cam thread portion 160 is formed at the shaft hole 100. The cam thread portion 160 is formed as a female thread at an inner peripheral wall of the shaft hole 100. The bolt thread portion 72 of the center bolt 70 can be threadably coupled with the cam thread portion 160.

The valve timing regulator 1 is fixed to the camshaft 4 by inserting the center bolt 70 through the inside of the vane rotor 30 and threadably coupling the bolt thread portion 72 with the cam thread portion 160. In the installed state where the valve timing regulator 1 is installed to the camshaft 4, the friction shim 50 is positioned between the opposing surface 401 and the shaft end surface 161 (see FIG. 1). Furthermore, at this time, the boss 31 of the vane rotor 30, the rotor 40 and the friction shim 50 are clamped between the bolt flange portion 73 of the center bolt 70 and the shaft end surface 161 of the camshaft 4 and receive an axial force of the center bolt 70. In this state, the vane rotor 30, the rotor 40, the friction shim 50 and the center bolt 70 can be rotated integrally with the camshaft 4, and the housing 20 is rotatable relative to the camshaft 4.

As shown in FIG. 1, supply holes 101 are formed at the camshaft 4. The supply holes 101 communicate between the outer peripheral wall of the camshaft 4 and the shaft hole 100. A supply oil passage 110, a retard oil passage 120 and an advance oil passage 130 are formed at the vane rotor 30, the rotor 40 and the center bolt 70.

The supply oil passage 110 is configured to communicate between the supply holes 101 and the inside of the bolt main body 71. The retard oil passage 120 is configured to communicate between the retard chambers 301 and the inside of the bolt main body 71. The advance oil passage 130 is configured to communicate between the advance chambers 302 and the inside of the bolt main body 71.

An oil pump (not shown), which serves as a hydraulic oil supply source, is connected to the supply oil passage 110. The oil pump can pump the hydraulic oil from an oil pan (not shown). Thereby, the hydraulic oil is supplied from the oil pump to the retard chambers 301 or the advance chambers 302 through the supply hole 101, the shaft hole 100, the supply oil passage 110, the inside of the bolt main body 71 and the corresponding one of the retard oil passage 120 or the advance oil passage 130.

The spool 80 is shaped generally in a cylindrical tubular form and is configured to reciprocate in the axial direction at the inside of the bolt main body 71. A plurality of holes is formed at the spool 80 such that the holes connect between an inner peripheral wall and an outer peripheral wall of the spool 80. Furthermore, a plurality of annular grooves is formed at the outer peripheral wall of the spool 80 such that the annular grooves are radially inwardly recessed at the outer peripheral wall of the spool 80.

The communication of the supply oil passage 110 to the retard oil passage 120 or the communication of the supply oil passage 110 to the advance oil passage 130 can be switched by reciprocating the spool 80 at the inside of the bolt main body 71. Thereby, when the supply oil passage 110 is communicated with the retard oil passage 120, the hydraulic oil is supplied from the oil pump to the respective retard chambers 301. In contrast, when the supply oil passage 110 is communicated with the advance oil passage 130, the hydraulic oil is supplied from the oil pump to the respective advance chambers 302.

When the supply oil passage 110 is communicated with the retard chambers 301, the advance chambers 302 are communicated with the inside of the spool 80. Thereby, the hydraulic oil in the respective advance chambers 302 is discharged to the oil pan through the one end portion of the spool 80. Furthermore, when the supply oil passage 110 is communicated with the advance chambers 302, the retard chambers 301 are communicated with the inside of the spool 80. Thereby, the hydraulic oil in the respective retard chambers 301 is discharged to the oil pan through the one end portion of the spool 80.

A retaining portion 91 is installed at an inside of an end portion of the bolt main body 71, which is opposite to the camshaft 4. The retaining portion 91 can limit axial movement of the spool 80 toward an opposite side, which is opposite to the camshaft 4, when the end portion of the spool 80 abuts against the retaining portion 91. A spring 92 is installed to an opposite side of the spool 80, which is opposite to the retaining portion 91. The spring 92 urges the spool 80 toward the retaining portion 91.

A linear solenoid (not shown) is installed to the end portion of the spool 80, which is located on the retaining portion 91 side. The linear solenoid can urge the spool 80 toward the camshaft 4 against an urging force of the spring 92.

An undepicted electronic control unit (hereinafter referred to as an ECU) is connected to the linear solenoid. The ECU is a small computer having a CPU, a ROM, a RAM and the like and controls devices and equipment installed to the vehicle based on various information inputted to the ECU. The ECU controls the operation of the linear solenoid to control the axial position of the spool 80 relative to the bolt main body 71 to switch the operation among the supply of the hydraulic oil to the respective retard chambers 301, the supply of the hydraulic oil to the respective advance chambers 302, the discharge of the hydraulic oil from the respective retard chambers 301 and the discharge of the hydraulic oil from the respective advance chambers 302, so that the vane rotor 30 is rotated relative to the housing 20, and thereby a phase difference of the camshaft 4 relative to the crankshaft 2 is regulated.

The valve timing regulator 1 of the present embodiment further includes a retard spring 14 and an engaging pin 15 (see FIGS. 2,3 and 4). The retard spring 14 is formed by spirally winding one end portion of a wire material made of, for example, metal. The retard spring 14 is installed to an opposite side of the front plate 23, which is opposite to the rear plate 21. The engaging pin 15 is shaped in a rod form and projects from the front plate 23 toward the side, which is opposite to the rear plate 21. The retard spring 14 is installed such that the one end portion of the retard spring 14 is engaged with the boss 31 of the vane rotor 30, and the other end portion of the retard spring 14 is engaged with the engaging pin 15. The retard spring 14 urges the vane rotor 30 in the advancing direction relative to the housing 20.

An urging force of the retard spring 14 is set to be larger than an average of variable torques exerted from the camshaft 4 to the vane rotor 30 in the retarding direction at the time of rotating the camshaft 4. In this way, when the hydraulic oil is not supplied to the advance chambers 302 and the retard chambers 301, the vane rotor 30 is urged in the advancing direction by the retard spring 14 and is placed at a most advanced position (see FIG. 3).

Next, the friction shim 50 and the contact member 60 will be described in detail. The friction shim 50 is made of, for example, metal and is shaped in a ring plate form (see FIGS. 2, 6A, 6B and 6C). In the present embodiment, an outer peripheral wall of the friction shim 50 is shaped generally in a cylindrical tubular form, and an outer diameter of the friction shim 50 is set to be generally the same as an inner diameter of the recess 41.

The friction shim 50 has a first shim contact surface 501 and a second shim contact surface 502. The first shim contact surface 501 is formed at one end surface of the friction shim 50. The second shim contact surface 502 is formed at the other end surface of the friction shim 50, which is opposite to the one end surface of the friction shim 50. In the present embodiment, the first shim contact surface 501 and the second shim contact surface 502 are roughened. Therefore, a surface roughness of the first shim contact surface 501 and a surface roughness of the second shim contact surface 502 are relatively large.

In a state before the installation of the valve timing regulator 1 to the camshaft 4, the friction shim 50 is fitted to the recess 41 of the rotor 40. In this state, the friction shim 50 is placed such that the second shim contact surface 502 contacts the opposing surface 401, and the outer peripheral portion of the friction shim 50 is engaged with the inner peripheral wall of the recess 41 of the rotor 40 (see FIG. 6A).

The contact member 60 includes a first member tubular portion 61, a second member tubular portion 62, a member plate portion 63, filter holes 64 filter portions 65 and snap fit portions 66 (see FIGS. 5, 6A, 6B and 6C). The first member tubular portion 61, the second member tubular portion 62, the member plate portion 63 and the snap fit portions 66 are formed integrally in one-piece from, for example, resin. The first member tubular portion 61 is shaped generally in a rectangular tubular form. The member plate portion 63 is shaped in a plate form to close one end of the first member tubular portion 61. A through hole, which is shaped in a circular form, is formed at a center of the member plate portion 63 such that the through hole extends through the member plate portion 63 in a plate thickness direction of the member plate portion 63.

The second member tubular portion 62 is shaped generally in a cylindrical tubular form and extends from an outer peripheral portion of the through hole of the member plate portion 63 toward a side, which is opposite to the first member tubular portion 61. The second member tubular portion 62 is formed to be divided into four segments in a circumferential direction of the second member tubular portion 62 (see FIG. 5).

The snap fit portions 66 are respectively formed at outer peripheral walls of two of the four divided segments of the second member tubular portion 62 while the two of the four divided segments are diametrically opposed to each other. Each of the snap fit portions 66 has a first claw 661 and a second claw 662. The first claw 661 radially outwardly projects from the outer peripheral wall of the corresponding segment of the second member tubular portion 62 and extends in the circumferential direction. At the outer peripheral wall of the corresponding segment of the second member tubular portion 62, the second claw 662 is placed on a side of the first claw 661, at which the member plate portion 63 is placed, and the second claw 662 radially outwardly projects from the outer peripheral wall of the corresponding segment of the second member tubular portion 62 and extends in the circumferential direction (see FIG. 5).

The snap fit portions 66 are configured to be coupled to the inner peripheral portion 43 of the rotor 40 by snap fit. When the snap fit portions 66 are coupled to the inner peripheral portion 43 of the rotor 40 by the snap fit, the contact member 60 is held by the rotor 40 in a state where the inner peripheral portion 43 of the rotor 40 is held between the first claw 661 and the second claw 662 of the respective snap fit portions 66 (see FIG. 6A).

Figure 5:
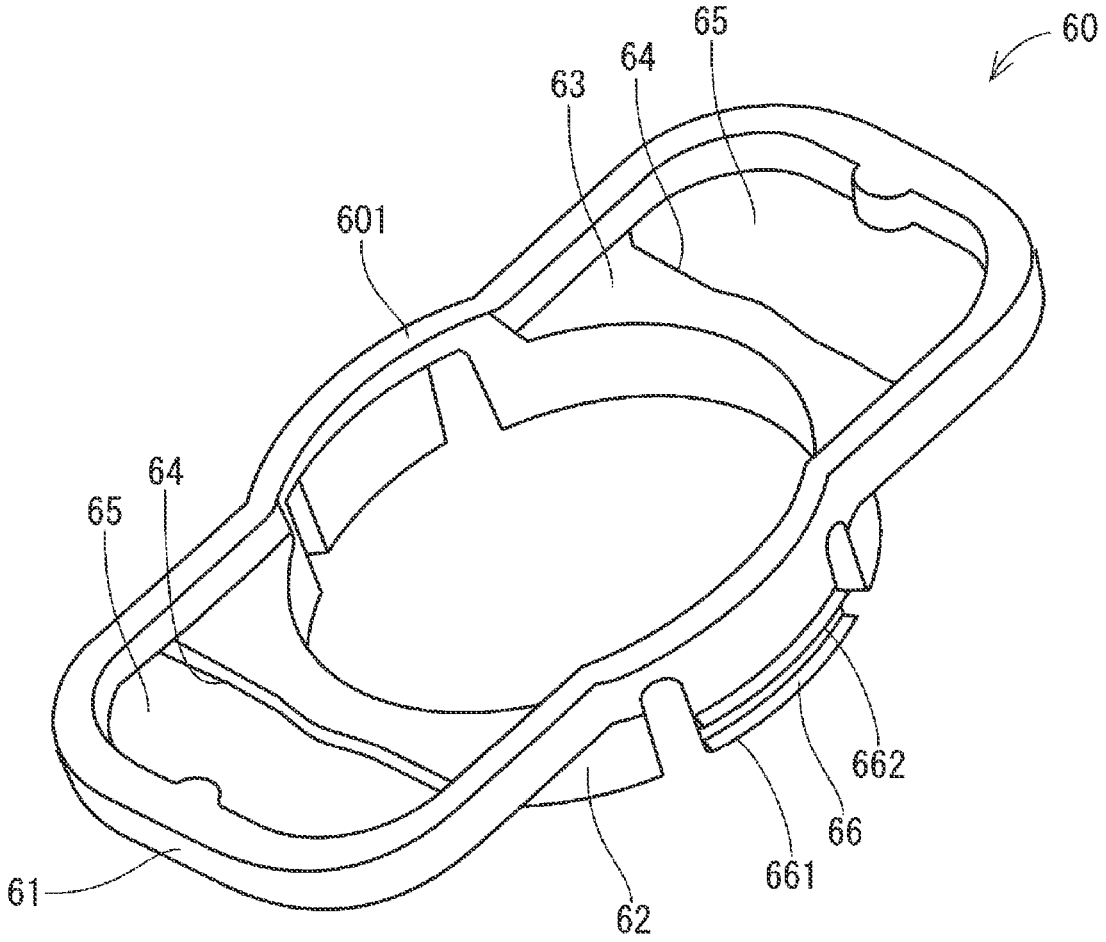
FIG. 5 is a perspective view showing a contact member of the valve timing regulator according to the first embodiment.

The number of the filter holes 64 is two, and these two filter holes 64 extend through the member plate portion 63 in a plate thickness direction of the member plate portion 63 while the through hole at the center of the member plate portion 63 is interposed between these two filter holes 64 (see FIG. 5). Each of the filter portions 65 is in a form of a mesh and is placed to close a corresponding one of the filter holes 64.

In a state where the valve timing regulator 1 is installed to the camshaft 4, the filter portions 65 are located between the supply oil passage 110 and the supply holes 101 (see FIG. 2). Thereby, the filter portions 65 can capture foreign objects contained in the hydraulic oil to be supplied to the retard chambers 301 and the advance chambers 302.

Next, the installation of the valve timing regulator 1 to the camshaft 4 will be described.

Figure 6A:
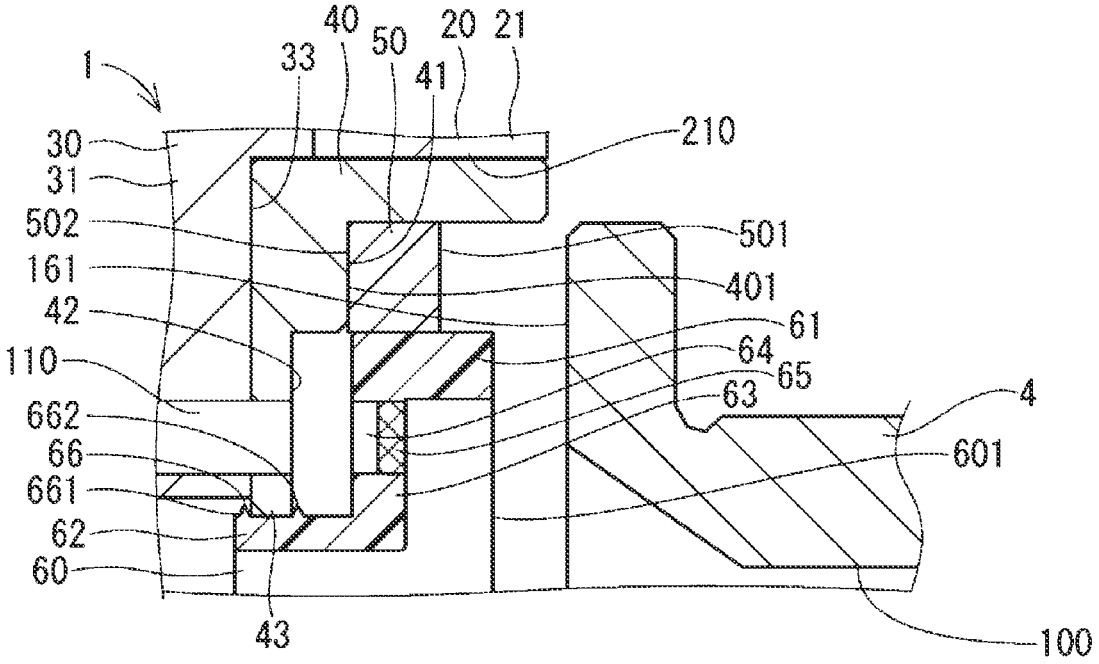
FIG. 6A is a descriptive view for describing an installation procedure of installing the valve timing regulator of the first embodiment to a driven shaft while indicating a state before the installation of the valve timing regulator.

As shown in FIG. 6A, in the state before the installation of the valve timing regulator 1 to the camshaft 4, the friction shim 50 is installed to the rotor 40 such that the second shim contact surface 502 of the friction shim 50 contacts the opposing surface 401, and the outer peripheral portion of the friction shim 50 is engaged to the inner peripheral wall of the recess 41. Furthermore, the contact member 60 is held by the rotor 40 in the state where the snap fit portions 66 of the contact member 60 are coupled to the inner peripheral portion 43 of the rotor 40 by the snap fit. Specifically, the contact member 60 is held by the rotor 40 in the state where the snap fit portions 66 are engaged to the inner peripheral portion 43.

Here, the snap fit portions 66 respectively serve as engaging portions. In the state where these engaging portions are engaged to the rotor 40, a first member contact surface 601 of the contact member 60 is located on a side of the first shim contact surface 501, which is opposite to the opposing surface 401, i.e., is located on the camshaft 4 side. Furthermore, an annular space is formed between the member plate portion 63 and the bottom surface of the rotor recess 42.

Figure 6B:
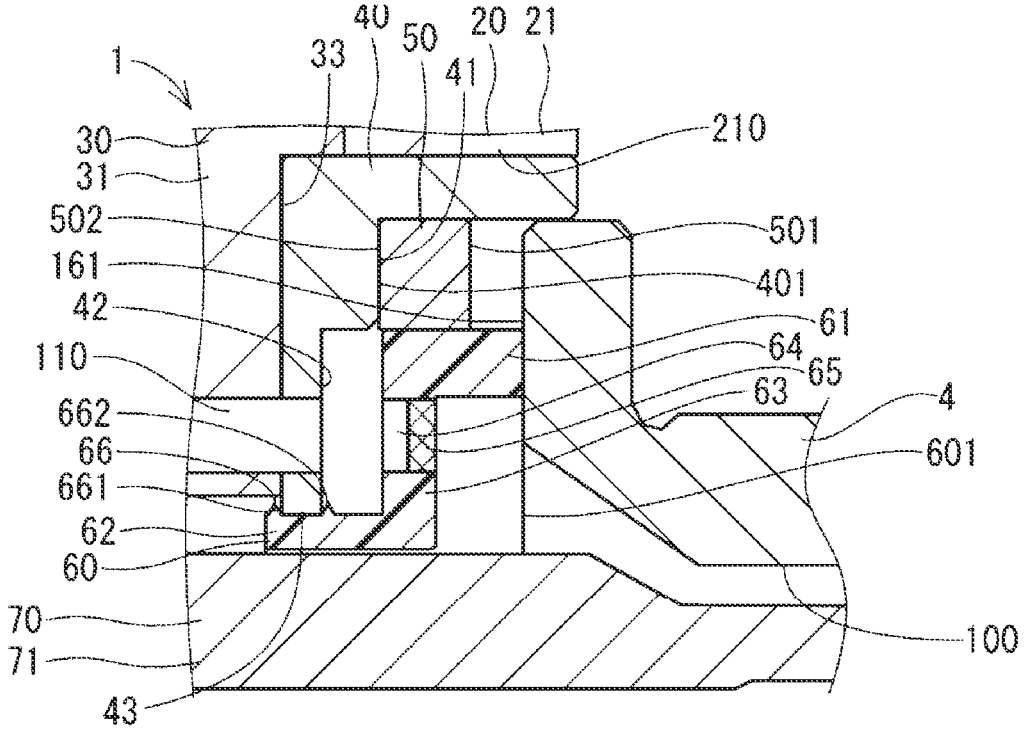
FIG. 6B is a descriptive view for describing the installation procedure of installing the valve timing regulator of the first embodiment to the driven shaft while indicating a state in the middle of the installation of the valve timing regulator.

As shown in FIG. 6B, when the valve timing regulator 1 is brought close to the camshaft 4 in order to install the valve timing regulator 1 to the camshaft 4, the first member contact surface 601 contacts the shaft end surface 161 at first. At this time, the first shim contact surface 501 does not contact the shaft end surface 161.

Then, in the state where the first member contact surface 601 contacts the shaft end surface 161, a relative position between the vane rotor 30 and the camshaft 4 is adjusted (see FIG. 6B). At this time, the first member contact surface 601 and the shaft end surface 161 can slide relative to each other, but the first shim contact surface 501 and the shaft end surface 161 do not slide relative to each other.

Next, the center bolt 70 is installed at the inside of the vane rotor 30, the rotor 40, the friction shim 50 and the contact member 60 and is inserted into the shaft hole 100, and the center bolt 70 is rotated to tightly couple the vane rotor 30 and the rotor 40 to the camshaft 4 (see FIG. 6B). At this time, the first member contact surface 601 and the shaft end surface 161 can slide relative to each other, but the first shim contact surface 501 and the shaft end surface 161 do not slide relative to each other.

Figure 6C:
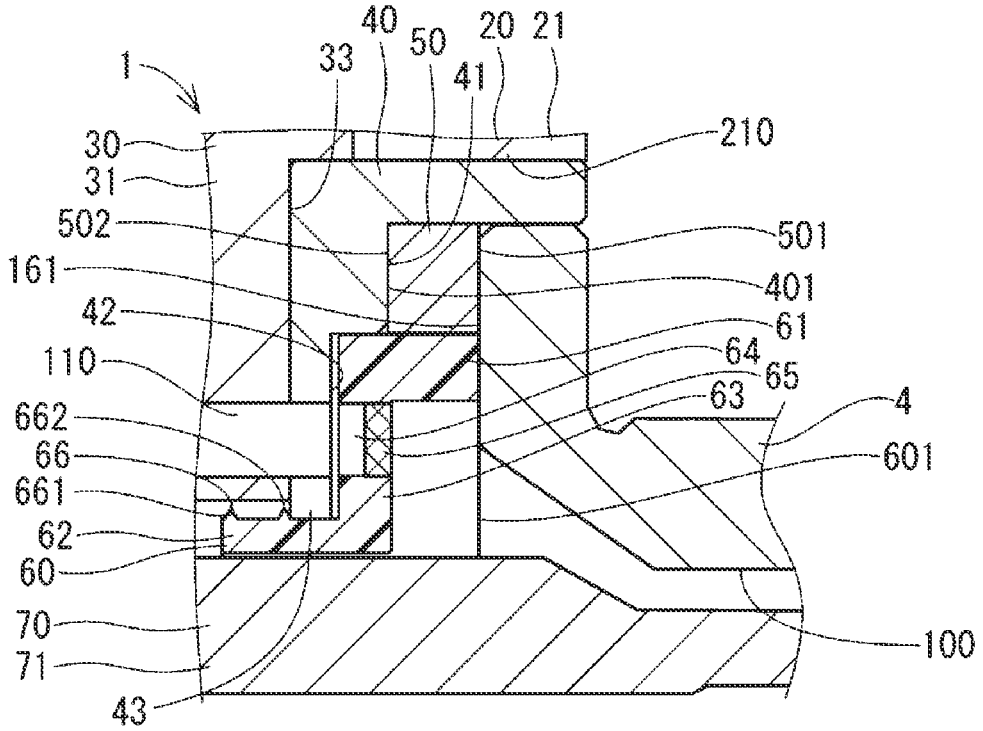
FIG. 6C is a descriptive view for describing the installation procedure of installing the valve timing regulator of the first embodiment to the driven shaft while indicating a state after the installation of the valve timing regulator.

When the center bolt 70 is further rotated, the contact member 60 is urged toward the vane rotor 30 by the shaft end surface 161, so that the second claws 662 of the snap fit portions 66 are moved toward the vane rotor 30 beyond the inner peripheral portion 43 of the rotor 40 (see FIG. 6C). Furthermore, at this time, the first shim contact surface 501 contacts the shaft end surface 161. The center bolt 70 is threadably inserted into the camshaft 4 such that a predetermined axial force is applied from the center bolt 70 to the vane rotor 30, the rotor 40 and the friction shim 50. Thereby, the installation of the valve timing regulator 1 to the camshaft 4 is completed.

After the installation of the valve timing regulator 1 to the camshaft 4, a frictional force is generated between the first shim contact surface 501 of the friction shim 50 and the shaft end surface 161 of the camshaft 4, and also a frictional force is generated between the second shim contact surface 502 of the friction shim 50 and the opposing surface 401 of the rotor 40. Therefore, slippage, which is caused by relative rotation of the vane rotor 30 and the rotor 40 relative to the camshaft 4, can be limited.

Figure 7:
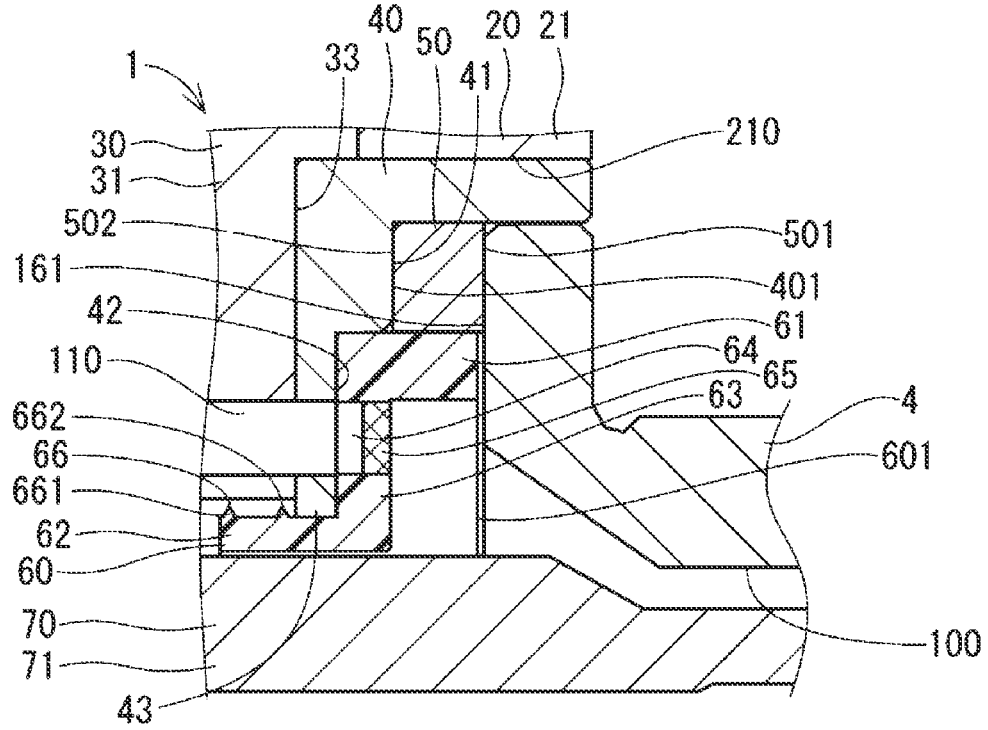
FIG. 7 is a cross-sectional view showing the contact member of the valve timing regulator and the vicinity thereof according to first embodiment.

In the present embodiment, after the installation of the valve timing regulator 1 to the camshaft 4, the contact member 60 can reciprocate in the axial direction at the inside of the friction shim 50 and the rotor 40. Therefore, the first member contact surface 601 can be moved away from the shaft end surface 161 (see FIG. 7). Furthermore, the member plate portion 63 can contact the bottom surface of the rotor recess 42. As discussed above, after the installation of the valve timing regulator 1 to the camshaft 4, the first member contact surface 601 is placed at the same position as that of the first shim contact surface 501 or is placed on the side of the first shim contact surface 501, which is opposite to the camshaft 4.

As discussed above, in the present embodiment, at the time of installing the valve timing regulator 1 to the camshaft 4, the contact member 60 is installed to the rotor 40 such that the first member contact surface 601 is placed on the side of the first shim contact surface 501, which is opposite to the opposing surface 401, and thereby the first member contact surface 601 contacts the shaft end surface 161 before occurrence of contact of the first shim contact surface 501 to the shaft end surface 161.

Alternatively, the contact member 60 may be installed to the rotor 40 such that the first member contact surface 601 is placed on the side of the first shim contact surface 501, which is opposite to the opposing surface 401, in the state before the installation of the valve timing regulator 1 to the camshaft 4, and the first member contact surface 601 is placed at the same position as that of the first shim contact surface 501 or is placed on the side of the first shim contact surface 501, which is opposite to the camshaft 4, after the installation of the valve timing regulator 1 to the camshaft 4.

Next, the operation of the valve timing regulator 1 will be described. FIGS. 2 and 3 indicate the state of the valve timing regulator 1 before the engine start, i.e., the time of stopping the engine 10.

<Engine Start Time>

In the state where the engine 10 is stopped, the vane rotor 30 is placed at the most advanced position (see FIG. 3).

<Retarding Operation Time>

In a case where the rotational phase of the camshaft 4 relative to the crankshaft 2 is on the advance side of a target value, a retarding operation of the valve timing regulator 1 is executed by the ECU. At the time of executing the retarding operation of the valve timing regulator 1, the ECU controls the drive electric current supplied to the linear solenoid. By this control operation, the spool 80 connects the supply oil passage 110 to the retard oil passage 120. Thereby, the hydraulic oil is supplied to the retard chambers 301. The oil pressure of the respective retard chambers 301 is applied to the corresponding vane 32 to generate a torque that urges the vane rotor 30 in the retarding direction. At this time, the hydraulic oil of the respective advance chambers 302 is discharged to the oil pan. The torque generated by the oil pressure in the respective retard chambers 301 is exerted against the torque generated by the retard spring 14 in the advancing direction, so that the vane rotor 30 is rotated relative to the housing 20 in the retarding direction.

<Advancing Operation Time>

In a case where the rotational phase of the camshaft 4 relative to the crankshaft 2 is on the retard side of a target value, an advancing operation of the valve timing regulator 1 is executed by the ECU. At the time of executing the advancing operation of the valve timing regulator 1, the ECU controls the drive electric current supplied to the linear solenoid. By this control operation, the spool 80 connects the supply oil passage 110 to the advance oil passage 130. Thereby, the hydraulic oil is supplied to the advance chambers 302. The oil pressure of the respective advance chambers 302 is applied to the corresponding vane 32 to generate a torque that urges the vane rotor 30 in the advancing direction. At this time, the hydraulic oil of the respective retard chambers 301 is discharged to the oil pan. A resultant force, which is a sum of the torques generated by the oil pressures in the advance chambers 302 and the torque generated by the retard spring 14, is exerted, so that the vane rotor 30 is rotated relative to the housing 20 in the advancing direction.

<Phase Holding Operation Time>

When the rotational phase of the camshaft 4 relative to the crankshaft 2 reaches the target value, a duty ratio of the drive electric current supplied to the linear solenoid is controlled by the ECU. By this control operation, the spool 80 connects the supply oil passage 110 to the retard oil passage 120 and the advance oil passage 130. Thereby, the hydraulic oil is supplied to the retard chambers 301 and the advance chambers 302. Thus, the vane rotor 30 is held at the target phase.

As described above, according to the present embodiment, there is provided the valve timing regulator 1 configured to be installed to the camshaft 4 of the engine 10 and regulate the valve timing of the engine 10 while the valve timing regulator 1 includes: the housing 20; the vane rotor 30 and the rotor 40; the friction shim 50; and the contact member 60.

The housing 20 is configured to rotate synchronously with the crankshaft 2 of the engine 10. The rotor 40 has the opposing surface 401 that is the surface opposed to the shaft end surface 161, which is the end surface of the camshaft 4. The rotor 40 forms the retard chambers 301 and the advance chambers 302 between the housing 20 and the rotor 40, and the rotor 40 is configured to be rotated together with the camshaft 4 relative to the housing 20 by the hydraulic oil supplied to the retard chambers 301 or the advance chambers 302. The friction shim 50 is placed between the opposing surface 401 and the shaft end surface 161 and has the first shim contact surface 501, which is configured to contact the shaft end surface 161, and the second shim contact surface 502, which is configured to contact the opposing surface 401. The friction shim 50 is configured to generate the frictional force between the first shim contact surface 501 and the shaft end surface 161 and the frictional force between the second shim contact surface 502 and the opposing surface 401 after the installation of the valve timing regulator 1 to the camshaft 4. The contact member 60 has the first member contact surface 601 configured to contact the shaft end surface 161.

The contact member 60 is installed to the rotor 40 such that the first member contact surface 601 contacts the shaft end surface 161 before occurrence of contact of the first shim contact surface 501 to the shaft end surface 161 at the time of installing the valve timing regulator 1 to the camshaft 4. Therefore, at the time of installing the valve timing regulator 1 to the camshaft 4, even when the relative position of the vane rotor 30 and the rotor 40 relative to the camshaft 4 is adjusted or when the vane rotor 30 and the rotor 40 are tightly coupled to the camshaft 4 by rotating the center bolt 70, the first shim contact surface 501 of the friction shim 50 and the shaft end surface 161 do not slide relative to each other although the first member contact surface 601 of the contact member 60 and the shaft end surface 161 slide relative to each other. Thereby, it is possible to limit generation of wear particles between the friction shim 50 and the camshaft 4.

As described above, according to the present embodiment, at the time of installing the valve timing regulator 1 to the camshaft 4, it is possible to limit the generation of the wear particles between the friction shim 50 and the camshaft 4, and thereby it is possible to limit mixing of the wear particles, i.e., foreign objects into the hydraulic oil to be supplied to the retard chambers 301 and the advance chambers 302 of the valve timing regulator 1. Thus, the malfunction of the valve timing regulator 1 can be limited.

Furthermore, in the present embodiment, the rotor 40 has the inner peripheral portion 43, which is shaped in the ring form. The contact member 60 has the snap fit portions 66, which can be coupled to the inner peripheral portion 43 of the rotor 40 by the snap fit. Therefore, the contact member 60 can be easily installed to the rotor 40. Also, the contact member 60 can be easily held by the rotor 40 before the installation of the valve timing regulator 1 to the camshaft 4.

Furthermore, in the present embodiment, the contact member 60 has the filter portions 65, which can capture the foreign objects contained in the hydraulic oil to be supplied to the retard chambers 301 and the advance chambers 302. Therefore, the function of the contact member 60 and the function of the filter portions 65 are integrated in the contact member 60, and thereby the number of the components can be reduced. Furthermore, even when the wear particles are generated between the friction shim 50 and the camshaft 4, the wear particles can be captured with the filter portions 65. Thereby, the malfunction of the valve timing regulator 1 can be limited.

Second Embodiment

Figure 8A:
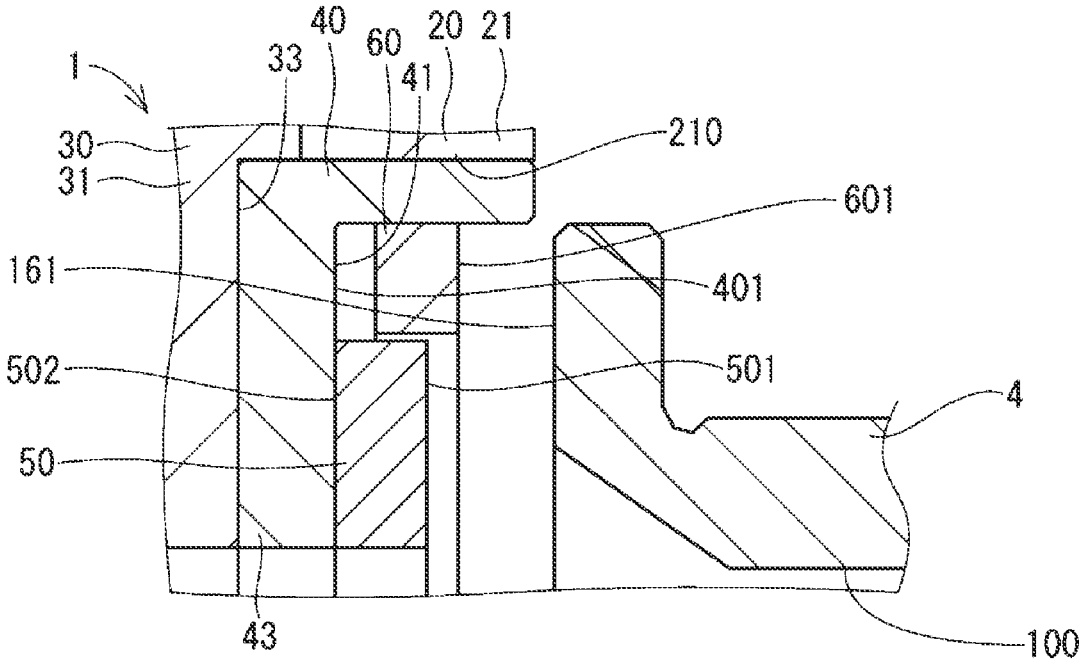
FIG. 8A is a descriptive view for describing an installation procedure of installing a valve timing regulator of a second embodiment to the driven shaft while indicating a state before the installation of the valve timing regulator.
Figure 8B:
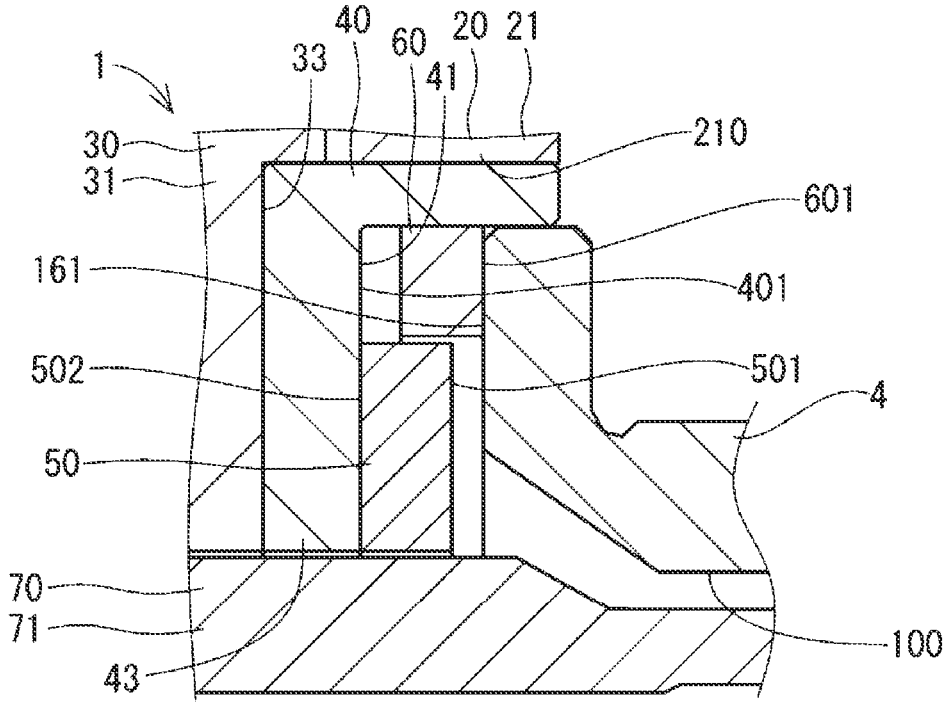
FIG. 8B is a descriptive view for describing the installation procedure of installing the valve timing regulator of the second embodiment to the driven shaft while indicating a state in the middle of the installation of the valve timing regulator.
Figure 8C:
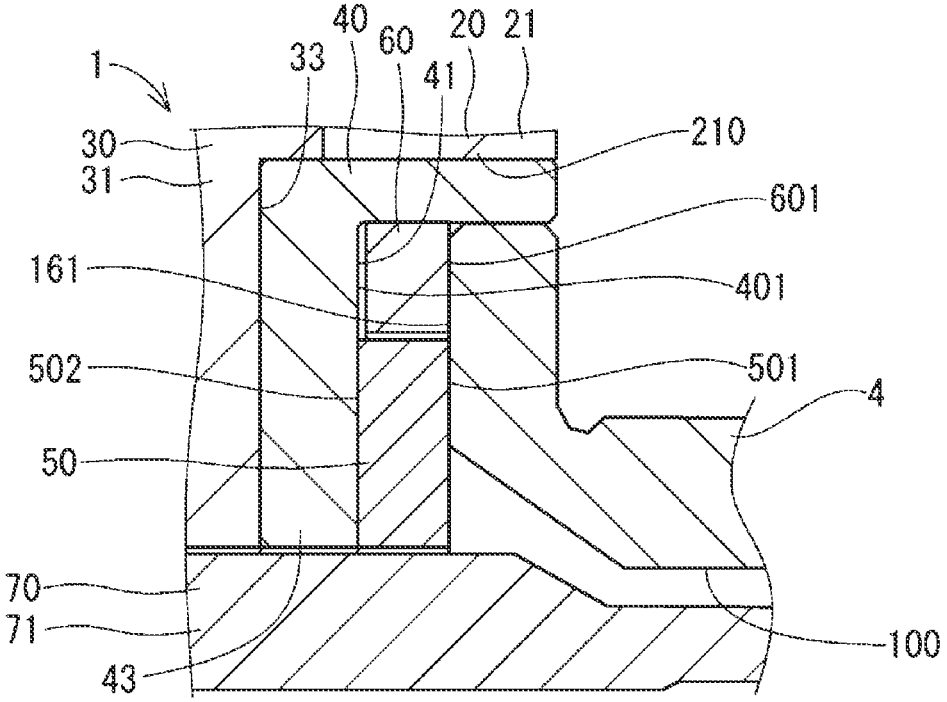
FIG. 8C is a descriptive view for describing the installation procedure of installing the valve timing regulator of the second embodiment to the driven shaft while indicating a state after the installation of the valve timing regulator.

FIGS. 8A, 8B and 8C respectively show a portion of a valve timing regulator according to a second embodiment. The second embodiment differs from the first embodiment with respect to, for example, the structure of the contact member 60.

In the present embodiment, the rotor 40 does not have the rotor recess 42. The friction shim 50 is shaped generally in a circular ring plate form and is made of, for example, metal. In the present embodiment, an outer peripheral wall and an inner peripheral wall of the friction shim 50 are respectively shaped generally in a cylindrical tubular form. Furthermore, an outer diameter of the friction shim 50 is set to be smaller than an inner diameter of the recess 41, and an inner diameter of the friction shim 50 is set to be generally equal to an inner diameter of the rotor 40. The friction shim 50 is installed to the bottom surface, i.e., the opposing surface 401 of the recess 41 such that the friction shim 50 is coaxial with the rotor 40. The friction shim 50 is installed to the opposing surface 401 by, for example, bonding.

In the present embodiment, the contact member 60 is shaped generally in a circular ring plate form and is made of, for example, metal. An outer peripheral wall and an inner peripheral wall of the contact member 60 are respectively shaped generally in a cylindrical tubular form. Furthermore, an outer diameter of the contact member 60 is set to be generally equal to an inner diameter of the recess 41, and an inner diameter of the contact member 60 is set to be slightly larger than the outer diameter of the friction shim 50. Furthermore, a plate thickness of the contact member 60 is smaller than a plate thickness of the friction shim 50. The first member contact surface 601 is formed at one end surface of the contact member 60.

Next, the installation of the valve timing regulator 1 to the camshaft 4 will be described.

As shown in FIG. 8A, in the state before the installation of the valve timing regulator 1 to the camshaft 4, the friction shim 50 is installed to the rotor 40 such that the second shim contact surface 502 of the friction shim 50 contacts the opposing surface 401. Furthermore, the contact member 60 is installed such that the contact member 60 is fitted to the recess 41 of the rotor 40. The contact member 60 is installed to the rotor 40 such that the end surface of the contact member 60, which is opposite to the first member contact surface 601, is opposed to the bottom surface, i.e., the opposing surface 401 of the recess 41, and the outer peripheral portion of the contact member 60 is engaged to the inner peripheral wall of the recess 41.

Here, the outer peripheral portion of the contact member 60 serves as an engaging portion. In the state where this engaging portion is engaged to the rotor 40, the first member contact surface 601 of the contact member 60 is located on the side of the first shim contact surface 501, which is opposite to the opposing surface 401, i.e., is located on the camshaft 4 side. Furthermore, an annular space is formed between the contact member 60 and the bottom surface, i.e., the opposing surface 401 of the recess 41. Additionally, an annular gap is formed between the inner peripheral portion of the contact member 60 and the outer peripheral portion of the friction shim 50.

As shown in FIG. 8B, when the valve timing regulator 1 is brought close to the camshaft 4 in order to install the valve timing regulator 1 to the camshaft 4, the first member contact surface 601 contacts the shaft end surface 161 at first. At this time, the first shim contact surface 501 does not contact the shaft end surface 161.

Then, in the state where the first member contact surface 601 contacts the shaft end surface 161, a relative position between the vane rotor 30 and the camshaft 4 is adjusted (see FIG. 8B). At this time, the first member contact surface 601 and the shaft end surface 161 can slide relative to each other, but the first shim contact surface 501 and the shaft end surface 161 do not slide relative to each other.

Next, the center bolt 70 is installed at the inside of the vane rotor 30, the rotor 40, the friction shim 50 and the contact member 60 and is inserted into the shaft hole 100, and the center bolt 70 is rotated to tightly couple the vane rotor 30 and the rotor 40 to the camshaft 4 (see FIG. 8B). At this time, the first member contact surface 601 and the shaft end surface 161 can slide relative to each other, but the first shim contact surface 501 and the shaft end surface 161 do not slide relative to each other.

When the center bolt 70 is further rotated, the contact member 60 is urged toward the vane rotor 30 by the shaft end surface 161, so that the contact member 60 is moved toward the vane rotor 30 (see FIG. 8C). Furthermore, at this time, the first shim contact surface 501 contacts the shaft end surface 161. The center bolt 70 is threadably inserted into the camshaft 4 such that a predetermined axial force is applied from the center bolt 70 to the vane rotor 30, the rotor 40 and the friction shim 50. Thereby, the installation of the valve timing regulator 1 to the camshaft 4 is completed.

After the installation of the valve timing regulator 1 to the camshaft 4, a frictional force is generated between the first shim contact surface 501 of the friction shim 50 and the shaft end surface 161 of the camshaft 4, and also a frictional force is generated between the second shim contact surface 502 of the friction shim 50 and the opposing surface 401 of the rotor 40. Therefore, slippage, which is caused by relative rotation of the vane rotor 30 and the rotor 40 relative to the camshaft 4, can be limited.

In the present embodiment, the contact member 60 forms an annular space between the contact member 60 and the opposing surface 401 after the installation of the valve timing regulator 1 to the camshaft 4. Furthermore, the first member contact surface 601 is placed at the same position as that of the first shim contact surface 501 or is placed on the side of the first shim contact surface 501, which is opposite to the camshaft 4 (see FIG. 8C).

As described above, in the present embodiment, the contact member 60 is installed to the rotor 40 such that the first member contact surface 601 contacts the shaft end surface 161 before occurrence of contact of the first shim contact surface 501 to the shaft end surface 161 at the time of installing the valve timing regulator 1 to the camshaft 4. Therefore, similar to the first embodiment, it is possible to limit the generation of the wear particles between the friction shim 50 and the camshaft 4, and thereby it is possible to limit mixing of the wear particles, i.e., the foreign objects into the hydraulic oil to be supplied to the retard chambers 301 and the advance chambers 302. Thus, the malfunction of the valve timing regulator 1 can be limited.

Furthermore, in the present embodiment, the rotor 40 has the recess 41, in which the opposing surface 401 is formed at the bottom surface of the recess 41. The contact member 60 is shaped in the ring form and is installed to the rotor 40 such that the outer peripheral portion of the contact member 60 is engaged to the inner peripheral wall of the recess 41. Therefore, the structure of the contact member 60 can be simplified, and the contact member 60 can be easily held by the rotor 40 before and after the installation of the valve timing regulator 1 to the camshaft 4.

Third Embodiment

Figure 9A:
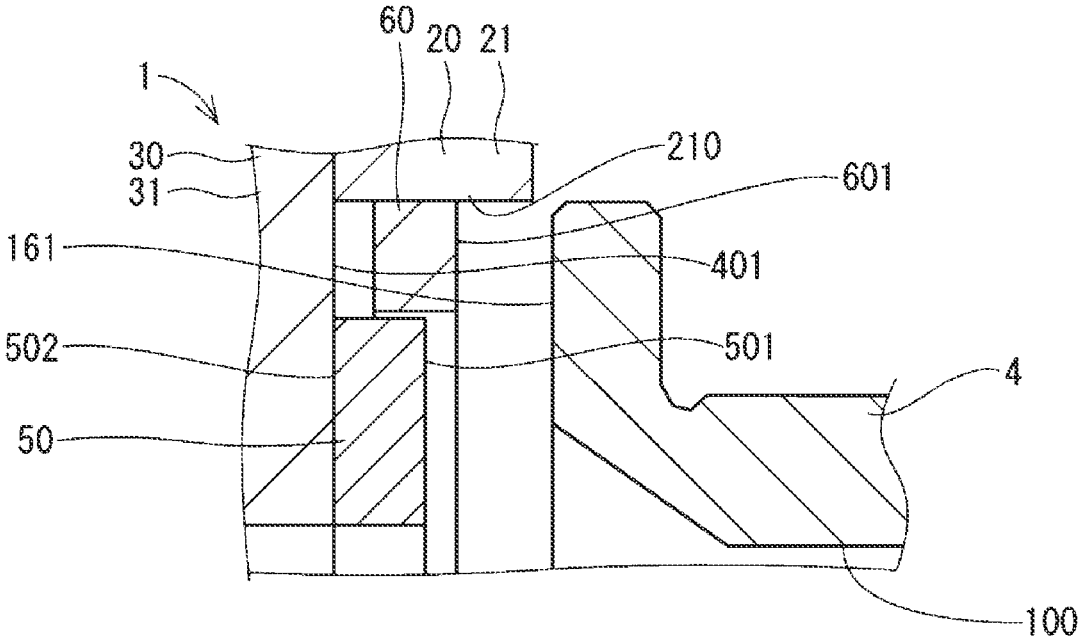
FIG. 9A is a descriptive view for describing an installation procedure of installing a valve timing regulator of a third embodiment to the driven shaft while indicating a state before the installation of the valve timing regulator.
Figure 9B:
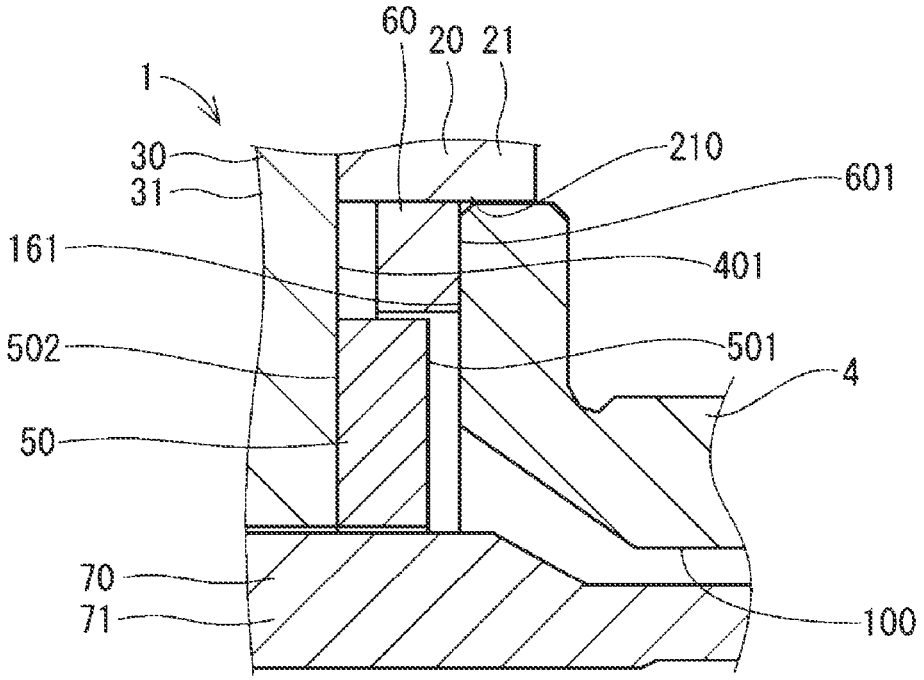
FIG. 9B is a descriptive view for describing the installation procedure of installing the valve timing regulator of the third embodiment to the driven shaft while indicating a state in the middle of the installation of the valve timing regulator.
Figure 9C:
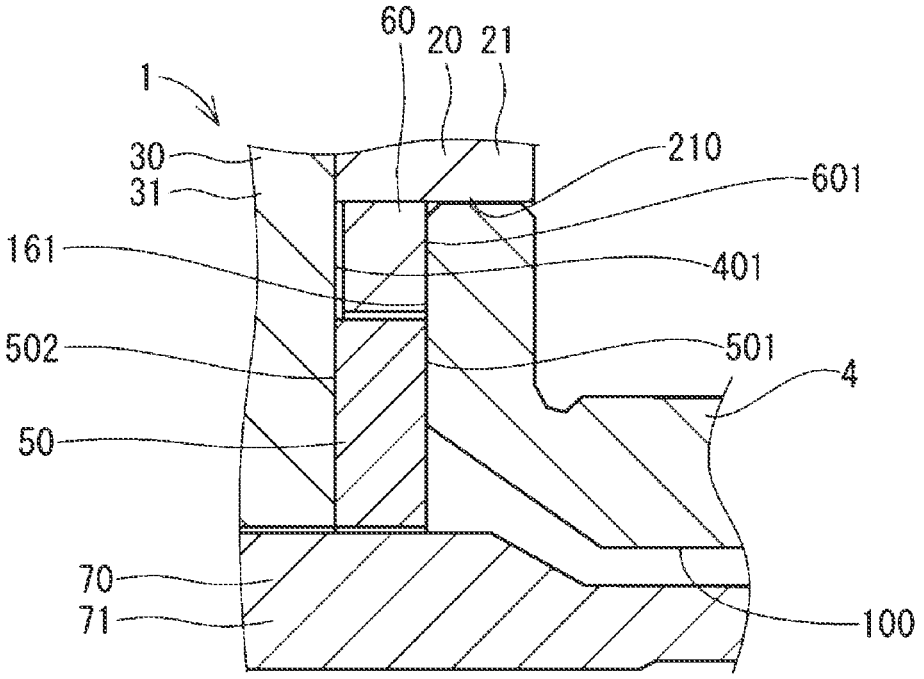
FIG. 9C is a descriptive view for describing the installation procedure of installing the valve timing regulator of the third embodiment to the driven shaft while indicating a state after the installation of the valve timing regulator.

FIGS. 9A, 9B and 9C respectively show a portion of a valve timing regulator according to a third embodiment. The third embodiment differs from the second embodiment with respect to, for example, the structure of the second rotatable body.

In the present embodiment, the rotor 40 is not provided, and the vane rotor 30 forms the second rotatable body. Furthermore, the vane rotor recess 33 is not formed at the vane rotor 30, and the opposing surface 401 is formed at the end surface of the boss 31, which is located on the side where the camshaft 4 is placed.

The rear plate 21 of the housing 20, which serves as the first rotatable body, has the inner peripheral portion 210, which is shaped generally in the circular ring form. An inner diameter of the inner peripheral portion 210 is slightly larger than an outer diameter of the end portion of the camshaft 4, which is located on the side where the shaft end surface 161 is placed.

The friction shim 50 is shaped generally in the circular ring plate form and is made of, for example, metal. In the present embodiment, the outer peripheral wall and the inner peripheral wall of the friction shim 50 are respectively shaped generally in the cylindrical tubular form. Furthermore, the outer diameter of the friction shim 50 is set to be smaller than the inner diameter of the inner peripheral portion 210, and the inner diameter of the friction shim 50 is set to be generally equal to an inner diameter of the boss 31. The friction shim 50 is installed to the end surface of the boss 31 located on the camshaft 4 side, i.e., the opposing surface 401 such that the friction shim 50 is coaxial with the boss 31. The friction shim 50 is installed to the opposing surface 401 by, for example, bonding.

The contact member 60 is shaped generally in a circular ring plate form and is made of, for example, metal. The outer peripheral wall and the inner peripheral wall of the contact member 60 are respectively shaped generally in a cylindrical tubular form. Furthermore, the outer diameter of the contact member 60 is set to be generally equal to the inner diameter of the inner peripheral portion 210, and the inner diameter of the contact member 60 is set to be slightly larger than the outer diameter of the friction shim 50. Furthermore, a plate thickness of the contact member 60 is smaller than a plate thickness of the friction shim 50. The first member contact surface 601 is formed at one end surface of the contact member 60.

Next, the installation of the valve timing regulator 1 to the camshaft 4 will be described.

As shown in FIG. 9A, in the state before the installation of the valve timing regulator 1 to the camshaft 4, the friction shim 50 is installed to the vane rotor 30 such that the second shim contact surface 502 of the friction shim 50 contacts the opposing surface 401. Furthermore, the contact member 60 is installed such that the contact member 60 is fitted to the inner peripheral portion 210 of the rear plate 21. The contact member 60 is installed to the rear plate 21 such that the end surface of the contact member 60, which is opposite to the first member contact surface 601, is opposed to the opposing surface 401, and the outer peripheral portion of the contact member 60 is engaged to the inner peripheral portion 210.

Here, the outer peripheral portion of the contact member 60 serves as an engaging portion. In the state where this engaging portion is engaged to the inner peripheral portion 210, the first member contact surface 601 of the contact member 60 is located on the side of the first shim contact surface 501, which is opposite to the opposing surface 401, i.e., is located on the camshaft 4 side. Furthermore, an annular space is formed between the contact member 60 and the opposing surface 401. Additionally, an annular gap is formed between the inner peripheral portion of the contact member 60 and the outer peripheral portion of the friction shim 50.

As shown in FIG. 9B, when the valve timing regulator 1 is brought close to the camshaft 4 in order to install the valve timing regulator 1 to the camshaft 4, the first member contact surface 601 contacts the shaft end surface 161 at first. At this time, the first shim contact surface 501 does not contact the shaft end surface 161.

Then, in the state where the first member contact surface 601 contacts the shaft end surface 161, a relative position between the vane rotor 30 and the camshaft 4 is adjusted (see FIG. 9B). At this time, the first member contact surface 601 and the shaft end surface 161 can slide relative to each other, but the first shim contact surface 501 and the shaft end surface 161 do not slide relative to each other.

Next, the center bolt 70 is installed at the inside of the vane rotor 30, the friction shim 50 and the contact member 60 and is inserted into the shaft hole 100, and the center bolt 70 is rotated to tightly couple the vane rotor 30 to the camshaft 4 (see FIG. 9B). At this time, the first member contact surface 601 and the shaft end surface 161 can slide relative to each other, but the first shim contact surface 501 and the shaft end surface 161 do not slide relative to each other.

When the center bolt 70 is further rotated, the contact member 60 is urged toward the vane rotor 30 by the shaft end surface 161, so that the contact member 60 is moved toward the vane rotor 30 (see FIG. 9C). Furthermore, at this time, the first shim contact surface 501 contacts the shaft end surface 161. The center bolt 70 is threadably inserted into the camshaft 4 such that a predetermined axial force is applied from the center bolt 70 to the vane rotor 30 and the friction shim 50. Thereby, the installation of the valve timing regulator 1 to the camshaft 4 is completed.

After the installation of the valve timing regulator 1 to the camshaft 4, a frictional force is generated between the first shim contact surface 501 of the friction shim 50 and the shaft end surface 161 of the camshaft 4, and also a frictional force is generated between the second shim contact surface 502 of the friction shim 50 and the opposing surface 401 of the vane rotor 30. Therefore, slippage, which is caused by relative rotation of the vane rotor 30 relative to the camshaft 4, can be limited.

In the present embodiment, the contact member 60 forms an annular space between the contact member 60 and the opposing surface 401 after the installation of the valve timing regulator 1 to the camshaft 4. Furthermore, the first member contact surface 601 is placed at the same position as that of the first shim contact surface 501 or is placed on the side of the first shim contact surface 501, which is opposite to the camshaft 4 (see FIG. 9C). Furthermore, the contact member 60 is rotatable integrally with the rear plate 21.

As described above, in the present embodiment, the contact member 60 is installed to the rear plate 21 of the housing 20 such that the first member contact surface 601 contacts the shaft end surface 161 before occurrence of contact of the first shim contact surface 501 to the shaft end surface 161 at the time of installing the valve timing regulator 1 to the camshaft 4. Therefore, similar to the second embodiment, it is possible to limit the generation of the wear particles between the friction shim 50 and the camshaft 4, and thereby it is possible to limit mixing of the wear particles, i.e., the foreign objects into the hydraulic oil to be supplied to the retard chambers 301 and the advance chambers 302. Thus, the malfunction of the valve timing regulator 1 can be limited.

Furthermore, in the present embodiment, the rear plate 21 of the housing 20 includes the inner peripheral portion 210, which is shaped in the annular form. The contact member 60 is shaped in the annular form and is installed to the rear plate 21 such that the outer peripheral portion of the contact member 60 is engaged to the inner peripheral portion 210 of the rear plate 21. Therefore, the structure of the contact member 60 can be simplified, and the contact member 60 can be easily held by the rear plate 21 before and after the installation of the valve timing regulator 1 to the camshaft 4.

Fourth Embodiment

Figure 10A:
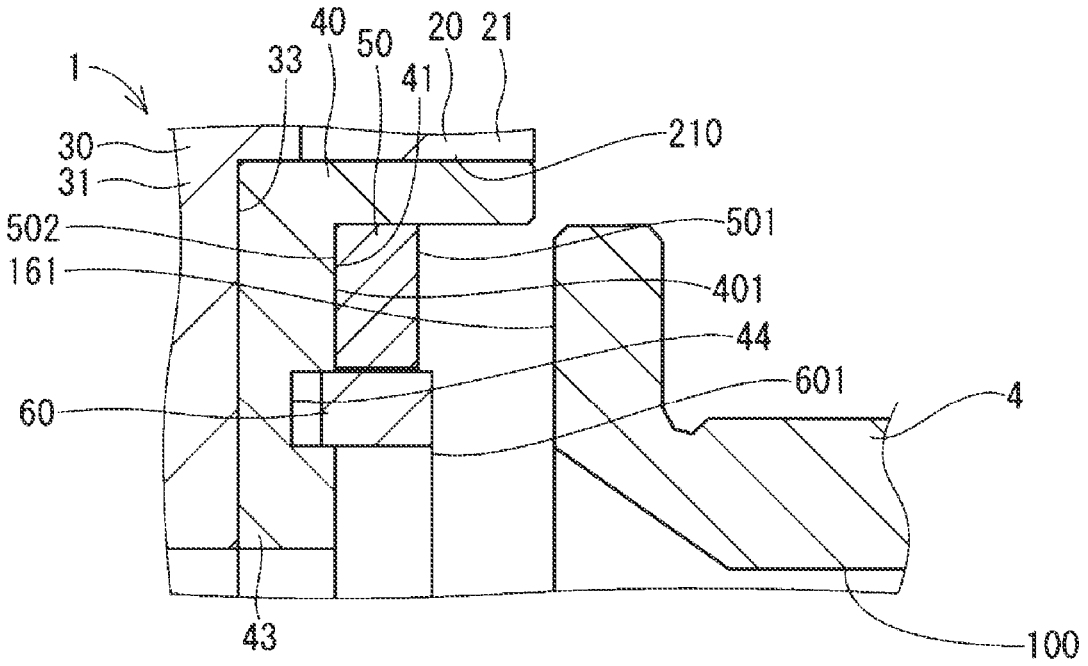
FIG. 10A is a descriptive view for describing an installation procedure of installing a valve timing regulator of a fourth embodiment to the driven shaft while indicating a state before the installation of the valve timing regulator.
Figure 10B:
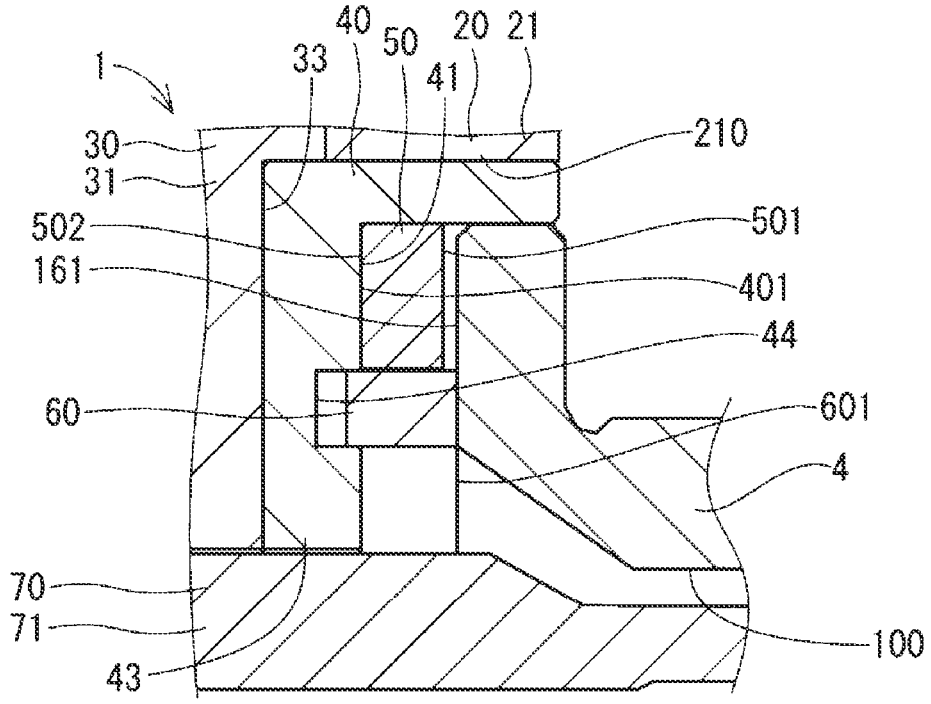
FIG. 10B is a descriptive view for describing the installation procedure of installing the valve timing regulator of the fourth embodiment to the driven shaft while indicating a state in the middle of the installation of the valve timing regulator.
Figure 10C:
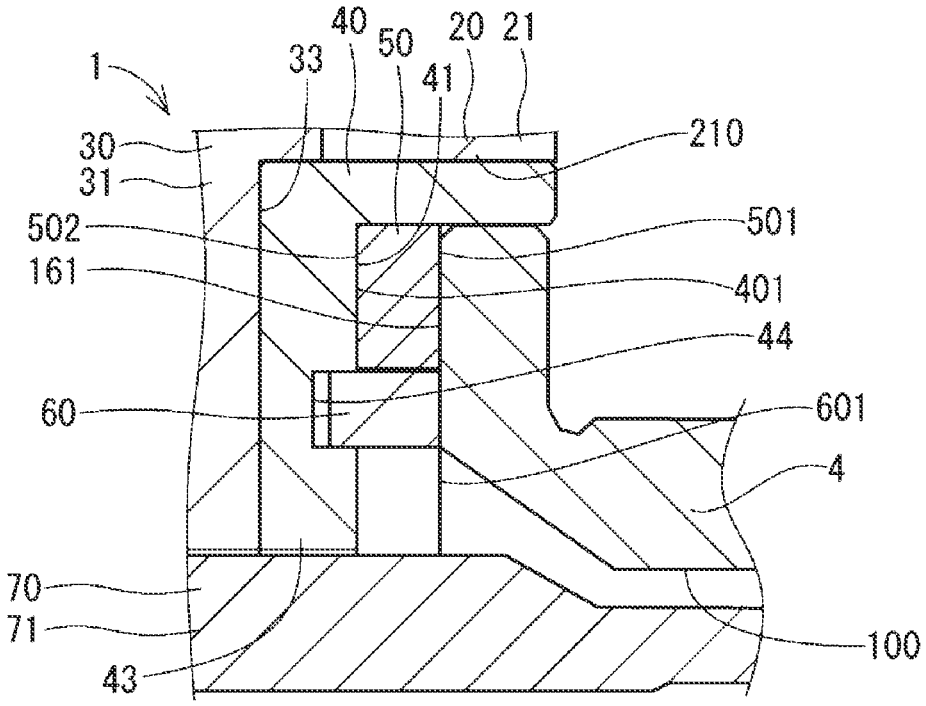
FIG. 10C is a descriptive view for describing the installation procedure of installing the valve timing regulator of the fourth embodiment to the driven shaft while indicating a state after the installation of the valve timing regulator.

FIGS. 10A, 10B and 10C respectively show a portion of a valve timing regulator according to a fourth embodiment. The fourth embodiment differs from the second embodiment with respect to, for example, the structures of the rotor 40, the friction shim 50 and the contact member 60.

In the present embodiment, the rotor 40 has a groove 44. The groove 44 is shaped generally in an annular form and is recessed from the opposing surface 401 toward the side, which is opposite to the shaft end surface 161. The groove 44 is formed to be coaxial with the recess 41 of the rotor 40.

The friction shim 50 is shaped generally in a circular ring plate form and is made of, for example, metal. In the present embodiment, an outer peripheral wall and an inner peripheral wall of the friction shim 50 are respectively shaped generally in a cylindrical tubular form. Furthermore, an outer diameter of the friction shim 50 is set to be generally equal to the inner diameter of the recess 41 of the rotor 40, and an inner diameter of the friction shim 50 is set to be slightly larger than an outer diameter of the groove 44. The friction shim 50 is installed to the rotor 40 such that the friction shim 50 is fitted to the recess 41.

The contact member 60 is shaped generally in the circular ring plate form and is made of, for example, metal. An outer peripheral wall and an inner peripheral wall of the contact member 60 are respectively shaped generally in a cylindrical tubular form. Furthermore, an outer diameter of the contact member 60 is set to be generally equal to the outer diameter of the groove 44, and an inner diameter of the contact member 60 is set to be generally equal to an inner diameter of the groove 44. Furthermore, a plate thickness of the contact member 60 is larger than a plate thickness of the friction shim 50. The first member contact surface 601 is formed at one end surface of the contact member 60.

Next, the installation of the valve timing regulator 1 to the camshaft 4 will be described.

As shown in FIG. 10A, in the state before the installation of the valve timing regulator 1 to the camshaft 4, the friction shim 50 is installed to the rotor 40 such that the second shim contact surface 502 of the friction shim 50 contacts the opposing surface 401. Furthermore, the contact member 60 is installed such that the contact member 60 is fitted to the groove 44 of the rotor 40. The contact member 60 is installed to the rotor 40 such that the outer peripheral portion and the inner peripheral portion of the contact member 60 are engaged to the groove 44.

The outer peripheral portion and the inner peripheral portion of the contact member 60 serve as engaging portions. In the state where these engaging portions are engaged to the rotor 40, the first member contact surface 601 of the contact member 60 is located on the side of the first shim contact surface 501, which is opposite to the opposing surface 401, i.e., is located on the camshaft 4 side. Furthermore, an annular space is formed between the contact member 60 and a bottom surface of the groove 44. Additionally, an annular gap is formed between the outer peripheral portion of the contact member 60 and the inner peripheral portion of the friction shim 50.

As shown in FIG. 10B, when the valve timing regulator 1 is brought close to the camshaft 4 in order to install the valve timing regulator 1 to the camshaft 4, the first member contact surface 601 contacts the shaft end surface 161 at first. At this time, the first shim contact surface 501 does not contact the shaft end surface 161.

Then, in the state where the first member contact surface 601 contacts the shaft end surface 161, a relative position between the vane rotor 30 and the camshaft 4 is adjusted (see FIG. 10B). At this time, the first member contact surface 601 and the shaft end surface 161 can slide relative to each other, but the first shim contact surface 501 and the shaft end surface 161 do not slide relative to each other.

Next, the center bolt 70 is installed at the inside of the vane rotor 30, the rotor 40, the friction shim 50 and the contact member 60 and is inserted into the shaft hole 100, and the center bolt 70 is rotated to tightly couple the vane rotor 30 and the rotor 40 to the camshaft 4 (see FIG. 10B). At this time, the first member contact surface 601 and the shaft end surface 161 can slide relative to each other, but the first shim contact surface 501 and the shaft end surface 161 do not slide relative to each other.

When the center bolt 70 is further rotated, the contact member 60 is urged toward the vane rotor 30 by the shaft end surface 161, so that the contact member 60 is moved toward the vane rotor 30 (see FIG. 10C). Furthermore, at this time, the first shim contact surface 501 contacts the shaft end surface 161. The center bolt 70 is threadably inserted into the camshaft 4 such that a predetermined axial force is applied from the center bolt 70 to the vane rotor 30, the rotor 40 and the friction shim 50. Thereby, the installation of the valve timing regulator 1 to the camshaft 4 is completed.

After the installation of the valve timing regulator 1 to the camshaft 4, a frictional force is generated between the first shim contact surface 501 of the friction shim 50 and the shaft end surface 161 of the camshaft 4, and also a frictional force is generated between the second shim contact surface 502 of the friction shim 50 and the opposing surface 401 of the rotor 40. Therefore, slippage, which is caused by relative rotation of the vane rotor 30 and the rotor 40 relative to the camshaft 4, can be limited.

In the present embodiment, the contact member 60 forms an annular space between the contact member 60 and the bottom surface of the groove 44 after the installation of the valve timing regulator 1 to the camshaft 4. Furthermore, the first member contact surface 601 is placed at the same position as that of the first shim contact surface 501 or is placed on the side of the first shim contact surface 501, which is opposite to the camshaft 4 (see FIG. 10C). Furthermore, since the contact member 60 is shaped in the ring form, it is possible to limit leakage of the hydraulic oil to the outside through the location between the rotor 40 and the camshaft 4 in the state where the first member contact surface 601 contacts the shaft end surface 161 (see FIG. 10C).

As described above, in the present embodiment, the contact member 60 is installed to the rotor 40 such that the first member contact surface 601 contacts the shaft end surface 161 before occurrence of contact of the first shim contact surface 501 to the shaft end surface 161 at the time of installing the valve timing regulator 1 to the camshaft 4. Therefore, like in the second embodiment, it is possible to limit the generation of the wear particles between the friction shim 50 and the camshaft 4, and thereby it is possible to limit mixing of the wear particles, i.e., the foreign objects into the hydraulic oil to be supplied to the retard chambers 301 and the advance chambers 302. Thus, the malfunction of the valve timing regulator 1 can be limited.

Furthermore, in the present embodiment, the rotor 40 has the groove 44 that is recessed from the opposing surface 401 toward the side, which is opposite to the shaft end surface 161. The contact member 60 is shaped in the annular form and is installed to the rotor 40 such that the outer peripheral portion and the inner peripheral portion of the contact member 60 are engaged to the groove 44. Therefore, the structure of the contact member 60 can be simplified, and the contact member 60 can be easily held by the rotor 40 before and after the installation of the valve timing regulator 1 to the camshaft 4.

Fifth Embodiment

Figure 11A:
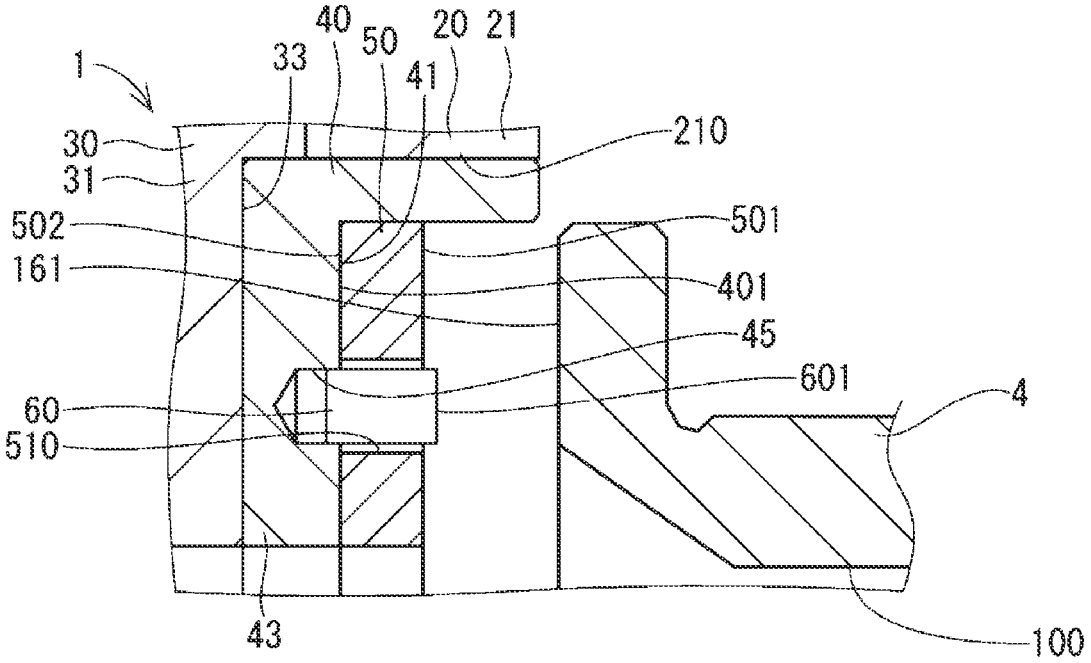
FIG. 11A is a descriptive view for describing an installation procedure of installing a valve timing regulator of a fifth embodiment to the driven shaft while indicating a state before the installation of the valve timing regulator.
Figure 11B:
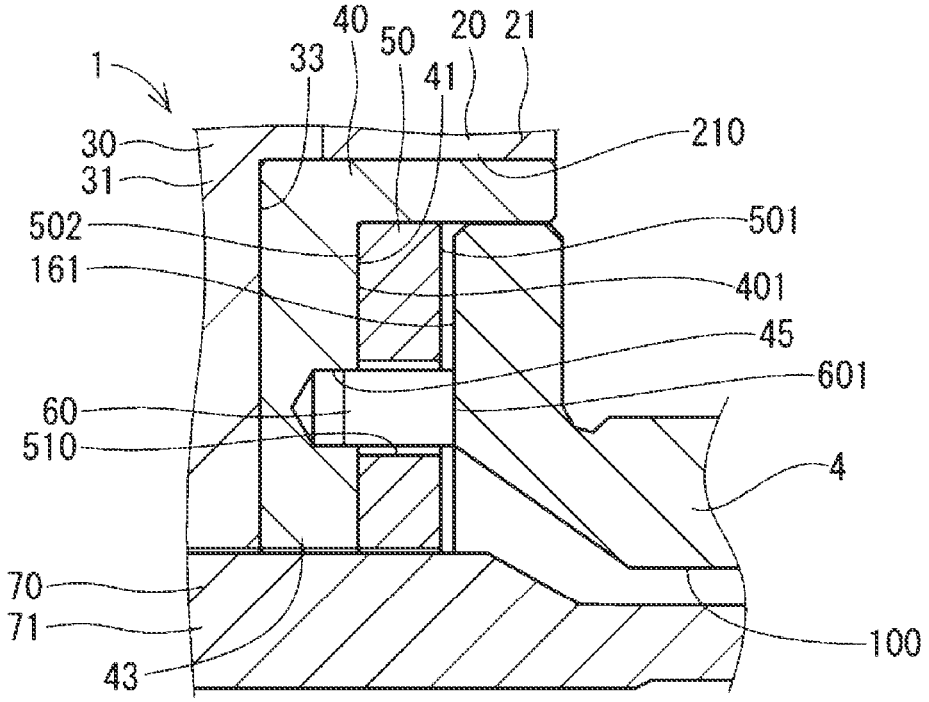
FIG. 11B is a descriptive view for describing the installation procedure of installing the valve timing regulator of the fifth embodiment to the driven shaft while indicating a state in the middle of the installation of the valve timing regulator.
Figure 11C:
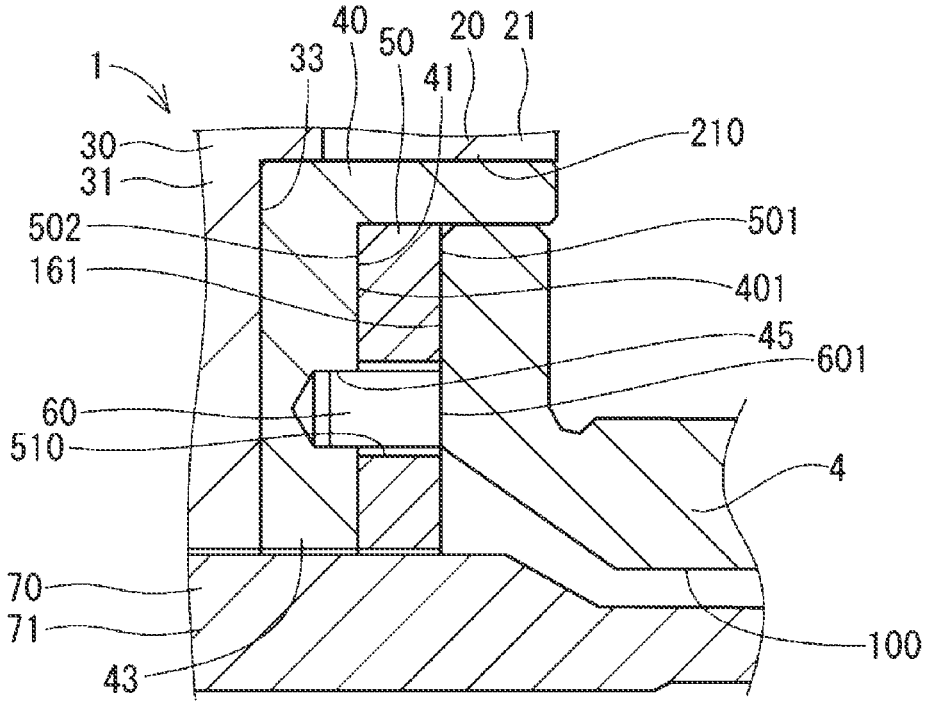
FIG. 11C is a descriptive view for describing the installation procedure of installing the valve timing regulator of the fifth embodiment to the driven shaft while indicating a state after the installation of the valve timing regulator.

FIGS. 11A, 11B and 11C respectively show a portion of a valve timing regulator according to a fifth embodiment. The fifth embodiment differs from the fourth embodiment with respect to, for example, the structures of the rotor 40, the friction shim 50 and the contact member 60.

In the present embodiment, the rotor 40 has a hole 45 in place of the groove 44. The hole 45 is shaped generally in a circular form and is recessed from the opposing surface 401 toward the side, which is opposite to the shaft end surface 161. The number of the hole 45 formed at the rotor 40 is one.

The friction shim 50 is shaped generally in a circular ring plate form and is made of, for example, metal. In the present embodiment, the outer peripheral wall and the inner peripheral wall of the friction shim 50 are respectively shaped generally in a cylindrical tubular form. Furthermore, an outer diameter of the friction shim 50 is set to be generally equal to the inner diameter of the recess 41, and an inner diameter of the friction shim 50 is set to be generally equal to the inner diameter of the rotor 40. The friction shim 50 is installed to the rotor 40 such that the friction shim 50 is fitted to the recess 41.

The friction shim 50 has a shim hole 510. The shim hole 510 is formed at a position, which corresponds to the hole 45, such that the shim hole 510 extends through the friction shim 50 in a plate thickness direction of the friction shim 50.

The contact member 60 is made of, for example, metal and is shaped generally in a cylindrical form, i.e., a rod form. An outer diameter of the contact member 60 is set to be generally equal to an inner diameter of the hole 45. An axial length of the contact member 60 is larger than a plate thickness of the friction shim 50. The first member contact surface 601 is formed at one end surface of the contact member 60.

Next, the installation of the valve timing regulator 1 to the camshaft 4 will be described.

As shown in FIG. 11A, in the state before the installation of the valve timing regulator 1 to the camshaft 4, the friction shim 50 is installed to the rotor 40 such that the second shim contact surface 502 of the friction shim 50 contacts the opposing surface 401. Furthermore, the contact member 60 is installed such that the contact member 60 is fitted to the hole 45 of the rotor 40. The contact member 60 is installed to the rotor 40 such that the outer peripheral wall of the contact member 60 is engaged to the hole 45. Here, the friction shim 50 is installed such that the shim hole 510 corresponds to the hole 45 of the rotor 40, and the contact member 60 extends through the shim hole 510 and is fitted to the hole 45.

Here, the outer peripheral wall of the contact member 60 serves as an engaging portion. In the state where this engaging portion is engaged to the rotor 40, the first member contact surface 601 of the contact member 60 is located on the side of the first shim contact surface 501, which is opposite to the opposing surface 401, i.e., is located on the camshaft 4 side. Furthermore, a space is formed between the contact member 60 and the bottom surface of the hole 45. An annular gap is formed between the outer peripheral wall of the contact member 60 and the shim hole 510 of the friction shim 50.

As shown in FIG. 11B, when the valve timing regulator 1 is brought close to the camshaft 4 in order to install the valve timing regulator 1 to the camshaft 4, the first member contact surface 601 contacts the shaft end surface 161 at first. At this time, the first shim contact surface 501 does not contact the shaft end surface 161.

Then, in the state where the first member contact surface 601 contacts the shaft end surface 161, a relative position between the vane rotor 30 and the camshaft 4 is adjusted (see FIG. 11B). At this time, the first member contact surface 601 and the shaft end surface 161 can slide relative to each other, but the first shim contact surface 501 and the shaft end surface 161 do not slide relative to each other.

Next, the center bolt 70 is installed at the inside of the vane rotor 30, the rotor 40, the friction shim 50 and is inserted into the shaft hole 100, and the center bolt 70 is rotated to tightly couple the vane rotor 30 and the rotor 40 to the camshaft 4 (see FIG. 11B). At this time, the first member contact surface 601 and the shaft end surface 161 can slide relative to each other, but the first shim contact surface 501 and the shaft end surface 161 do not slide relative to each other.

When the center bolt 70 is further rotated, the contact member 60 is urged toward the vane rotor 30 by the shaft end surface 161, so that the contact member 60 is moved toward the vane rotor 30 (see FIG. 11C). Furthermore, at this time, the first shim contact surface 501 contacts the shaft end surface 161. The center bolt 70 is threadably inserted into the camshaft 4 such that a predetermined axial force is applied from the center bolt 70 to the vane rotor 30, the rotor 40 and the friction shim 50. Thereby, the installation of the valve timing regulator 1 to the camshaft 4 is completed.

After the installation of the valve timing regulator 1 to the camshaft 4, a frictional force is generated between the first shim contact surface 501 of the friction shim 50 and the shaft end surface 161 of the camshaft 4, and also a frictional force is generated between the second shim contact surface 502 of the friction shim 50 and the opposing surface 401 of the rotor 40. Therefore, slippage, which is caused by relative rotation of the vane rotor 30 and the rotor 40 relative to the camshaft 4, can be limited.

In the present embodiment, the contact member 60 forms a space between the contact member 60 and a bottom surface of the hole 45 after the installation of the valve timing regulator 1 to the camshaft 4. Furthermore, the first member contact surface 601 is placed at the same position as that of the first shim contact surface 501 or is placed on the side of the first shim contact surface 501, which is opposite to the camshaft 4 (see FIG. 11C).

As described above, in the present embodiment, the contact member 60 is installed to the rotor 40 such that the first member contact surface 601 contacts the shaft end surface 161 before occurrence of contact of the first shim contact surface 501 to the shaft end surface 161 at the time of installing the valve timing regulator 1 to the camshaft 4. Therefore, similar to the fourth embodiment, it is possible to limit the generation of the wear particles between the friction shim 50 and the camshaft 4, and thereby it is possible to limit mixing of the wear particles, i.e., the foreign objects into the hydraulic oil to be supplied to the retard chambers 301 and the advance chambers 302. Thus, the malfunction of the valve timing regulator 1 can be limited.

Furthermore, in the present embodiment, the rotor 40 has the hole 45 that is recessed from the opposing surface 401 toward the side, which is opposite to the shaft end surface 161. The contact member 60 is shaped in the rod form and is installed to the rotor 40 such that the outer peripheral wall of the contact member 60 is engaged to the hole 45. Therefore, the structure of the contact member 60 can be simplified, and the contact member 60 can be easily held by the rotor 40 before and after the installation of the valve timing regulator 1 to the camshaft 4.

Sixth Embodiment

Figure 12A:
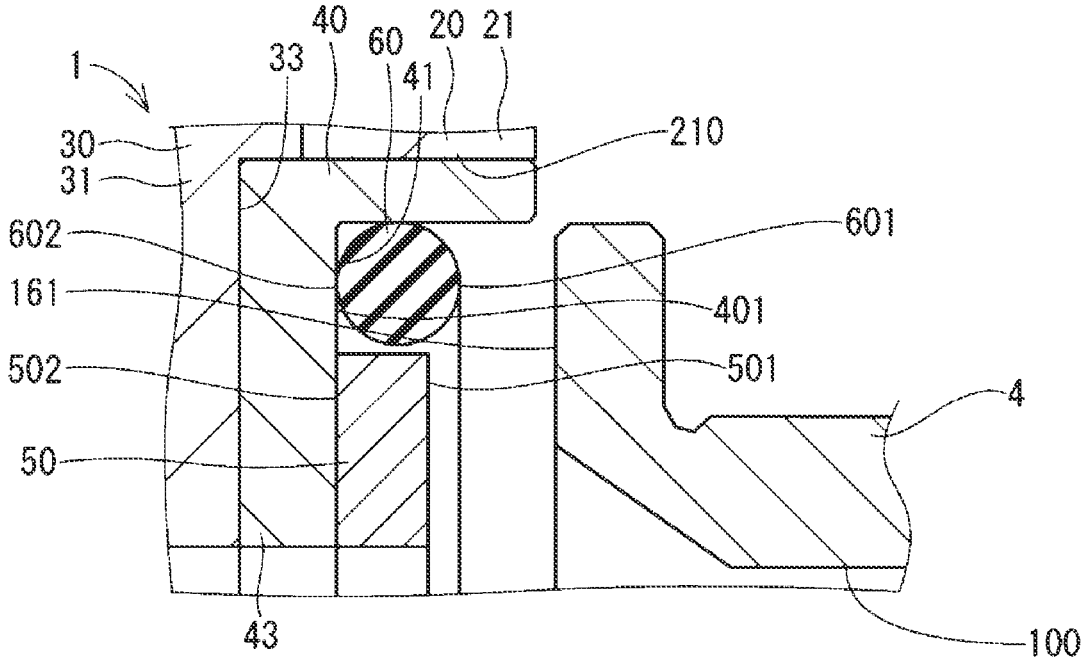
FIG. 12A is a descriptive view for describing an installation procedure of installing a valve timing regulator of a sixth embodiment to the driven shaft while indicating a state before the installation of the valve timing regulator.
Figure 12B:
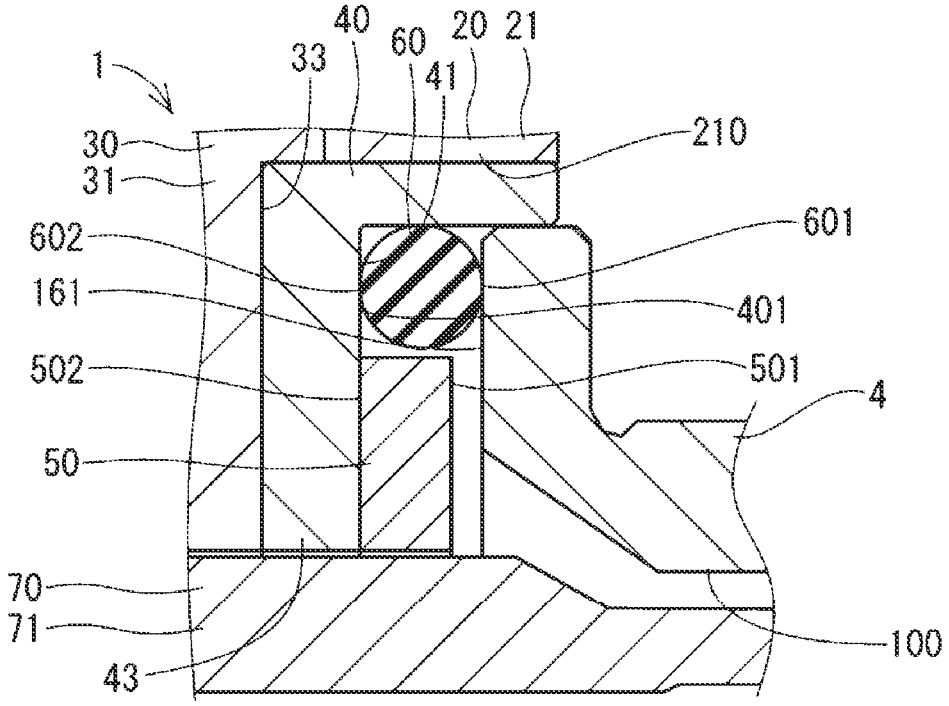
FIG. 12B is a descriptive view for describing the installation procedure of installing the valve timing regulator of the sixth embodiment to the driven shaft while indicating a state in the middle of the installation of the valve timing regulator.
Figure 12C:
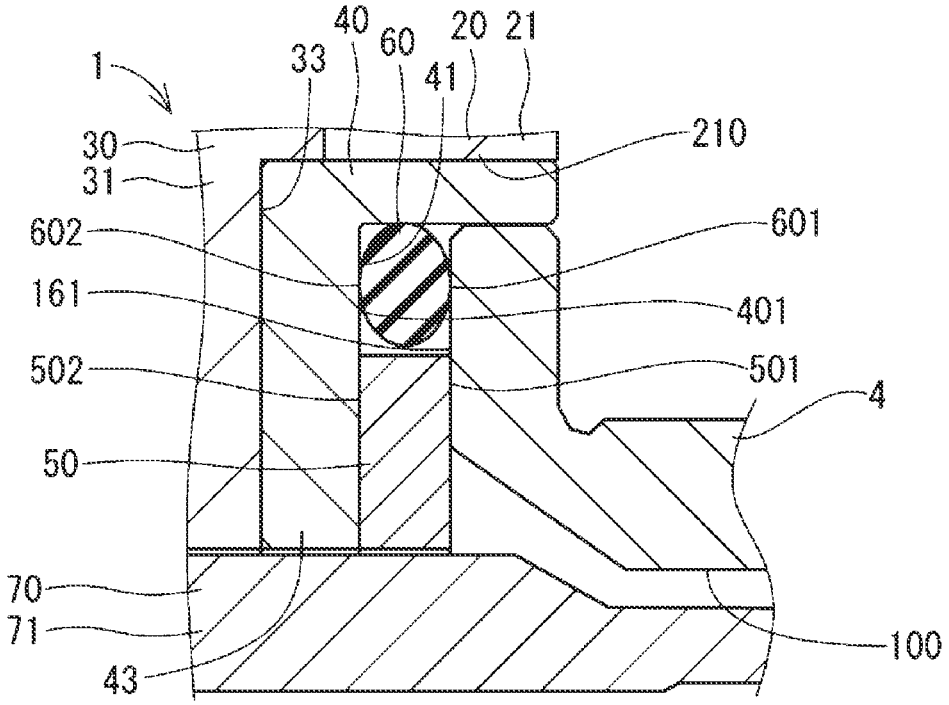
FIG. 12C is a descriptive view for describing the installation procedure of installing the valve timing regulator of the sixth embodiment to the driven shaft while indicating a state after the installation of the valve timing regulator.

FIGS. 12A, 12B and 12C respectively show a portion of a valve timing regulator according to a sixth embodiment. The sixth embodiment differs from the second embodiment with respect to, for example, the structure of the contact member 60.

In the present embodiment, the contact member 60 is shaped generally in a circular ring form and is made of an elastic member, such as rubber. The contact member 60 is elastically deformable in the axial direction. An outer diameter of the contact member 60 is generally equal to an inner diameter of the recess 41, and an inner diameter of the contact member 60 is slightly larger than an outer diameter of the friction shim 50. An axial length of the contact member 60 is larger than a plate thickness of the friction shim 50. The first member contact surface 601 is formed at one end surface of the contact member 60.

In the present embodiment, the contact member 60 has a second member contact surface 602. The second member contact surface 602 is formed at the other end surface of the contact member 60.

Next, the installation of the valve timing regulator 1 to the camshaft 4 will be described.

As shown in FIG. 12A, in the state before the installation of the valve timing regulator 1 to the camshaft 4, the friction shim 50 is installed to the rotor 40 such that the second shim contact surface 502 of the friction shim 50 contacts the opposing surface 401. Furthermore, the contact member 60 is installed such that the contact member 60 is fitted to the recess 41 of the rotor 40. The contact member 60 is installed to the rotor 40 such that the second member contact surface 602 of the contact member 60 contacts the opposing surface 401, and the outer peripheral portion of the contact member 60 is engaged to the inner peripheral wall of the recess 41.

Here, the outer peripheral portion of the contact member 60 serves as an engaging portion. In the state where this engaging portion is engaged to the rotor 40, the first member contact surface 601 of the contact member 60 is located on the side of the first shim contact surface 501, which is opposite to the opposing surface 401, i.e., is located on the camshaft 4 side. Furthermore, the second member contact surface 602 of the contact member 60 contacts the opposing surface 401.

As shown in FIG. 12B, when the valve timing regulator 1 is brought close to the camshaft 4 in order to install the valve timing regulator 1 to the camshaft 4, the first member contact surface 601 contacts the shaft end surface 161 at first. At this time, the first shim contact surface 501 does not contact the shaft end surface 161.

Then, in the state where the first member contact surface 601 contacts the shaft end surface 161, a relative position between the vane rotor 30 and the camshaft 4 is adjusted (see FIG. 12B). At this time, the first member contact surface 601 and the shaft end surface 161 can slide relative to each other, but the first shim contact surface 501 and the shaft end surface 161 do not slide relative to each other.

Next, the center bolt 70 is installed at the inside of the vane rotor 30, the rotor 40, the friction shim 50 and the contact member 60 and is inserted into the shaft hole 100, and the center bolt 70 is rotated to tightly couple the vane rotor 30 and the rotor 40 to the camshaft 4 (see FIG. 12B). At this time, the first member contact surface 601 and the shaft end surface 161 can slide relative to each other, but the first shim contact surface 501 and the shaft end surface 161 do not slide relative to each other.

When the center bolt 70 is further rotated, the second member contact surface 602 of the contact member 60 is urged toward the camshaft 4 by the opposing surface 401, so that the contact member 60 is compressed in the axial direction (see FIG. 12C). Furthermore, at this time, the first shim contact surface 501 contacts the shaft end surface 161. The center bolt 70 is threadably inserted into the camshaft 4 such that a predetermined axial force is applied from the center bolt 70 to the vane rotor 30, the rotor 40 and the friction shim 50. Thereby, the installation of the valve timing regulator 1 to the camshaft 4 is completed.

After the installation of the valve timing regulator 1 to the camshaft 4, a frictional force is generated between the first shim contact surface 501 of the friction shim 50 and the shaft end surface 161 of the camshaft 4, and also a frictional force is generated between the second shim contact surface 502 of the friction shim 50 and the opposing surface 401 of the rotor 40. Therefore, slippage, which is caused by relative rotation of the vane rotor 30 and the rotor 40 relative to the camshaft 4, can be limited.

In the present embodiment, after the installation of the valve timing regulator 1 to the camshaft 4, the first member contact surface 601 of the contact member 60 contacts the shaft end surface 161, and the second member contact surface 602 of the contact member 60 contacts the opposing surface 401, and the contact member 60 is compressed in the axial direction of the camshaft 4 by the shaft end surface 161 and the opposing surface 401 (see FIG. 12C). Furthermore, since the contact member 60 is made of the elastic member and is shaped in the ring form such that the contact member 60 is elastically deformable in the axial direction, the first member contact surface 601 of the contact member 60 tightly contacts the shaft end surface 161, and the second member contact surface 602 of the contact member 60 tightly contacts the opposing surface 401 (see FIG. 12C). Therefore, it is possible to reliably limit leakage of the hydraulic oil to the outside through the location between the rotor 40 and the camshaft 4. As discussed above, the contact member 60 also functions as a seal member that can maintain the liquid tightness between the rotor 40 and the camshaft 4. Furthermore, since the contact member 60 is made of the elastic member such that the contact member 60 is elastically deformable in the axial direction, the contact member 60 can be reused.

As described above, in the present embodiment, the contact member 60 is installed to the rotor 40 such that the first member contact surface 601 contacts the shaft end surface 161 before occurrence of contact of the first shim contact surface 501 to the shaft end surface 161 at the time of installing the valve timing regulator 1 to the camshaft 4. Therefore, similar to the second embodiment, it is possible to limit the generation of the wear particles between the friction shim 50 and the camshaft 4, and thereby it is possible to limit mixing of the wear particles, i.e., the foreign objects into the hydraulic oil to be supplied to the retard chambers 301 and the advance chambers 302. Thus, the malfunction of the valve timing regulator 1 can be limited.

Furthermore, in the present embodiment, the rotor 40 has the recess 41, in which the opposing surface 401 is formed at the bottom surface of the recess 41. The contact member 60 is shaped in the ring form and is installed to the rotor 40 such that the outer peripheral portion of the contact member 60 is engaged to the inner peripheral wall of the recess 41. Therefore, the structure of the contact member 60 can be simplified, and the contact member 60 can be easily held by the rotor 40 before and after the installation of the valve timing regulator 1 to the camshaft 4.

Furthermore, in the present embodiment, the contact member 60 is elastically deformable in the axial direction. Therefore, after the installation of the valve timing regulator 1 to the camshaft 4, the first member contact surface 601 of the contact member 60 contacts the shaft end surface 161, and the second member contact surface 602 of the contact member 60 contacts the opposing surface 401, and the contact member 60 is compressed in the axial direction of the camshaft 4 by the shaft end surface 161 and the opposing surface 401. Therefore, the first member contact surface 601 of the contact member 60 tightly contacts the shaft end surface 161, and the second member contact surface 602 of the contact member 60 tightly contacts the opposing surface 401. Therefore, it is possible to reliably limit leakage of the hydraulic oil to the outside through the location between the rotor 40 and the camshaft 4. Furthermore, since the contact member 60 is elastically deformable in the axial direction, the contact member 60 can be reused.

Seventh Embodiment

Figure 13A:
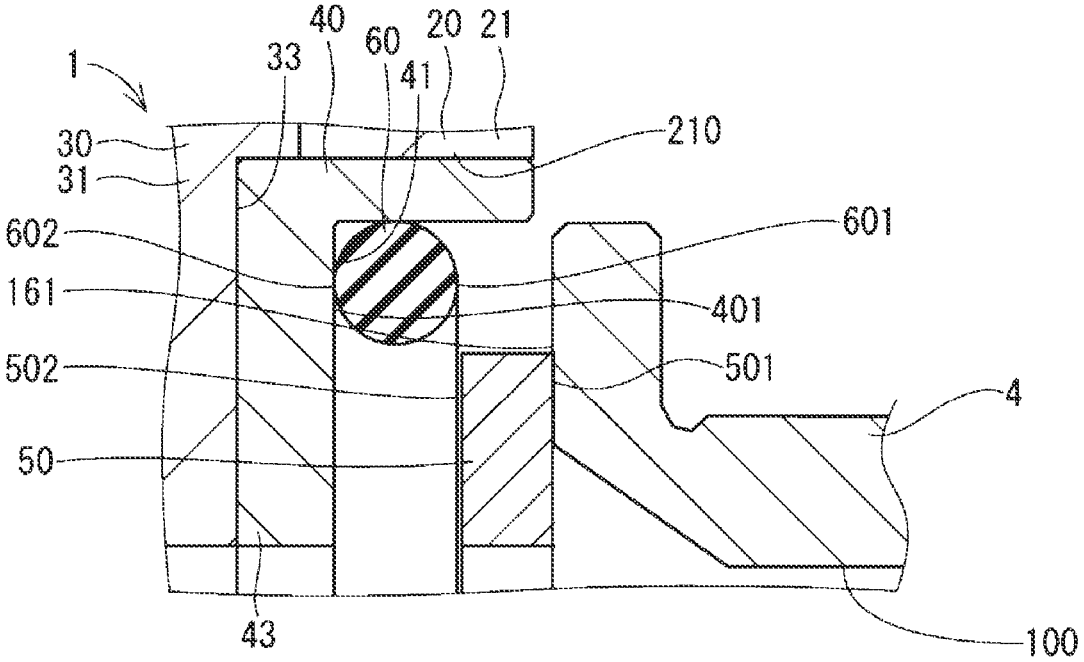
FIG. 13A is a descriptive view for describing an installation procedure of installing a valve timing regulator of a seventh embodiment to the driven shaft while indicating a state before the installation of the valve timing regulator.
Figure 13B:
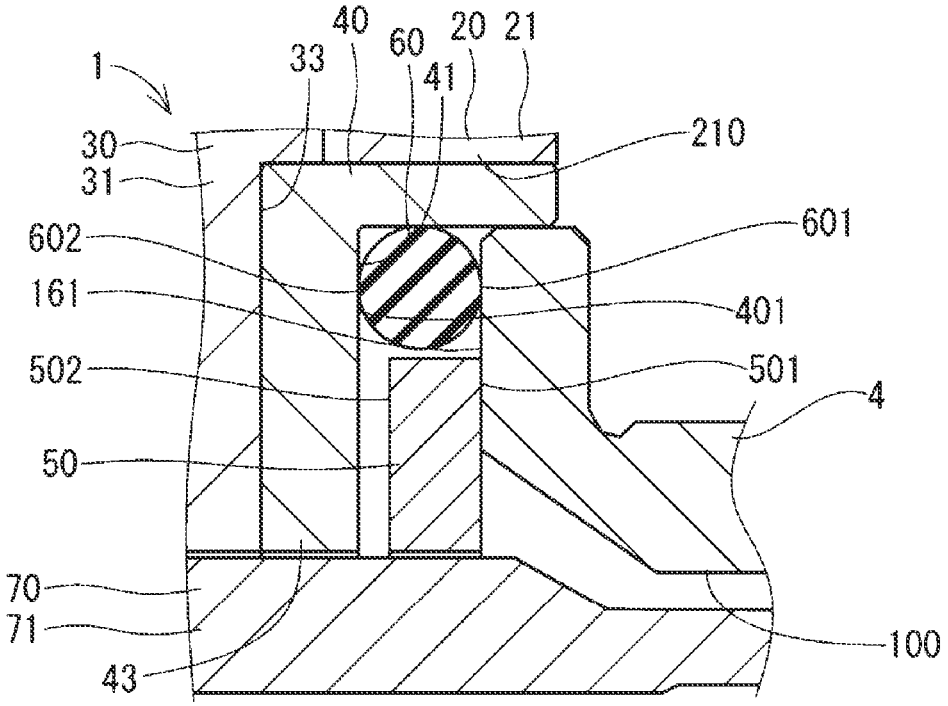
FIG. 13B is a descriptive view for describing the installation procedure of installing the valve timing regulator of the seventh embodiment to the driven shaft while indicating a state in the middle of the installation of the valve timing regulator.
Figure 13C:
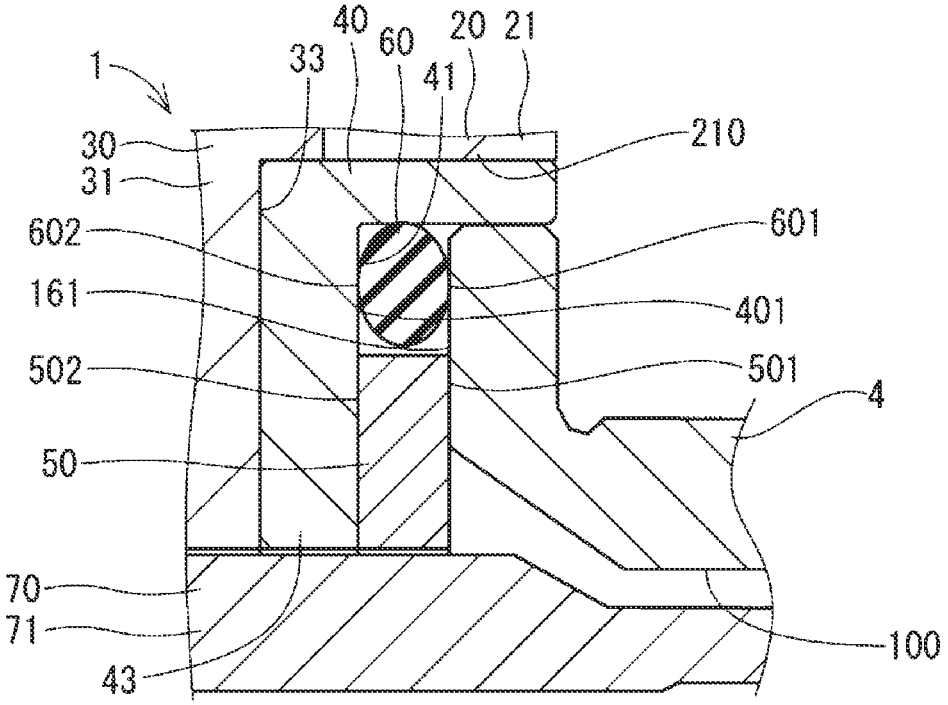
FIG. 13C is a descriptive view for describing the installation procedure of installing the valve timing regulator of the seventh embodiment to the driven shaft while indicating a state after the installation of the valve timing regulator.

FIGS. 13A, 13B and 13C respectively show a portion of a valve timing regulator according to a seventh embodiment. The seventh embodiment differs from the sixth embodiment with respect to the position of the friction shim 50 in the state before the installation of the valve timing regulator 1 to the camshaft 4.

Installation of the valve timing regulator 1 of the present embodiment to the camshaft 4 will be described.

As shown in FIG. 13A, in the state before the installation of the valve timing regulator 1 to the camshaft 4, the friction shim 50 is installed to the camshaft 4 such that the first shim contact surface 501 of the friction shim 50 contacts the shaft end surface 161. The friction shim 50 is installed to the shaft end surface 161 by, for example, bonding.

Like in the sixth embodiment, the contact member 60 is installed such that the contact member 60 is fitted to the recess 41 of the rotor 40. The contact member 60 is installed to the rotor 40 such that the second member contact surface 602 of the contact member 60 contacts the opposing surface 401, and the outer peripheral portion of the contact member 60 is engaged to the inner peripheral wall of the recess 41.

Here, the outer peripheral portion of the contact member 60 serves as an engaging portion. In the state where this engaging portion is engaged to the rotor 40, a distance between the first member contact surface 601 and the opposing surface 401 is larger than a distance between the second shim contact surface 502 and the shaft end surface 161.

As shown in FIG. 13B, when the valve timing regulator 1 is brought close to the camshaft 4 in order to install the valve timing regulator 1 to the camshaft 4, the first member contact surface 601 contacts the shaft end surface 161 at first. At this time, the second shim contact surface 502 does not contact the opposing surface 401.

Then, in the state where the first member contact surface 601 contacts the shaft end surface 161, a relative position between the vane rotor 30 and the camshaft 4 is adjusted (see FIG. 13B). At this time, the first member contact surface 601 and the shaft end surface 161 can slide relative to each other, but the second shim contact surface 502 and the opposing surface 401 do not slide relative to each other.

Next, the center bolt 70 is installed at the inside of the vane rotor 30, the rotor 40, the contact member 60 and the friction shim 50 and is inserted into the shaft hole 100, and the center bolt 70 is rotated to tightly couple the vane rotor 30 and the rotor 40 to the camshaft 4 (see FIG. 13B). At this time, the first member contact surface 601 and the shaft end surface 161 can slide relative to each other, but the second shim contact surface 502 and the opposing surface 401 do not slide relative to each other.

When the center bolt 70 is further rotated, the second member contact surface 602 of the contact member 60 is urged toward the camshaft 4 by the opposing surface 401, so that the contact member 60 is compressed in the axial direction (see FIG. 13C). Furthermore, at this time, the second shim contact surface 502 contacts the opposing surface 401. The center bolt 70 is threadably inserted into the camshaft 4 such that a predetermined axial force is applied from the center bolt 70 to the vane rotor 30, the rotor 40 and the friction shim 50. Thereby, the installation of the valve timing regulator 1 to the camshaft 4 is completed.

After the installation of the valve timing regulator 1 to the camshaft 4, a frictional force is generated between the first shim contact surface 501 of the friction shim 50 and the shaft end surface 161 of the camshaft 4, and also a frictional force is generated between the second shim contact surface 502 of the friction shim 50 and the opposing surface 401 of the rotor 40. Therefore, slippage, which is caused by relative rotation of the vane rotor 30 and the rotor 40 relative to the camshaft 4, can be limited.

In the present embodiment, after the installation of the valve timing regulator 1 to the camshaft 4, the first member contact surface 601 of the contact member 60 contacts the shaft end surface 161, and the second member contact surface 602 of the contact member 60 contacts the opposing surface 401, and the contact member 60 is compressed in the axial direction of the camshaft 4 by the shaft end surface 161 and the opposing surface 401 (see FIG. 13C). Therefore, like in the sixth embodiment, the contact member 60 can reliably limit leakage of the hydraulic oil to the outside through the location between the rotor 40 and the camshaft 4.

As described above, in the present embodiment, the contact member 60 is installed to the rotor 40 such that the first member contact surface 601 contacts the shaft end surface 161 before occurrence of contact of the second shim contact surface 502 to the opposing surface 401 at the time of installing the valve timing regulator 1 to the camshaft 4. Therefore, it is possible to limit the generation of the wear particles between the friction shim 50 and the rotor 40, and thereby it is possible to limit mixing of the wear particles, i.e., the foreign objects into the hydraulic oil to be supplied to the retard chambers 301 and the advance chambers 302. Thus, the malfunction of the valve timing regulator 1 can be limited.

Eighth Embodiment

Figure 14A:
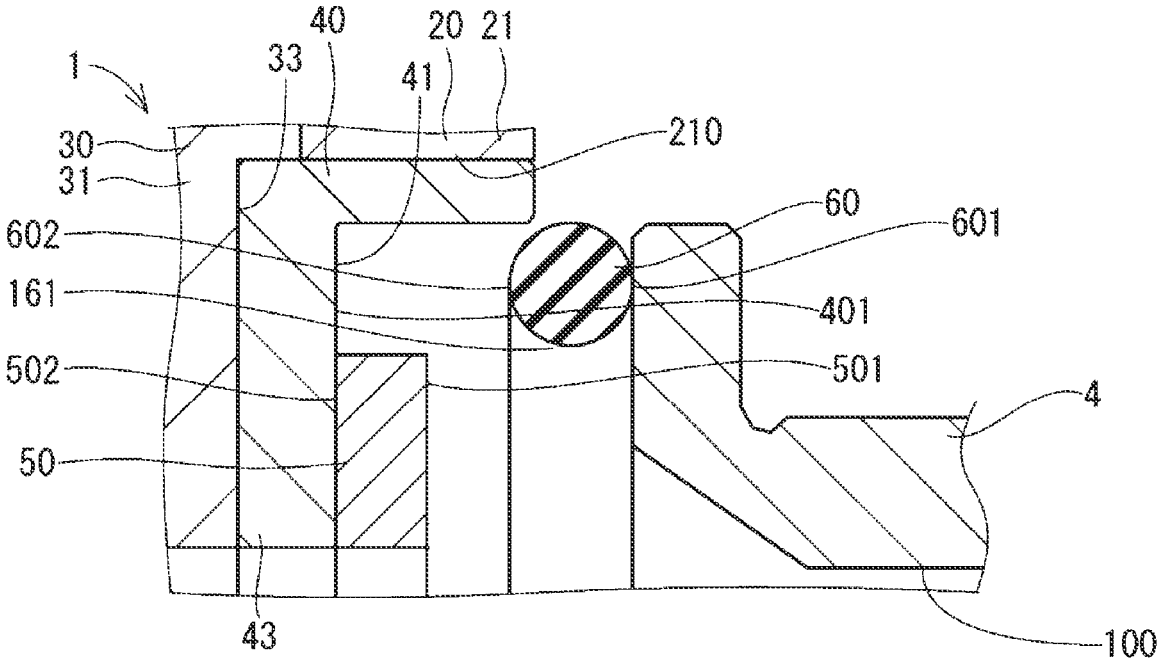
FIG. 14A is a descriptive view for describing an installation procedure of installing a valve timing regulator of an eighth embodiment to the driven shaft while indicating a state before the installation of the valve timing regulator.
Figure 14B:
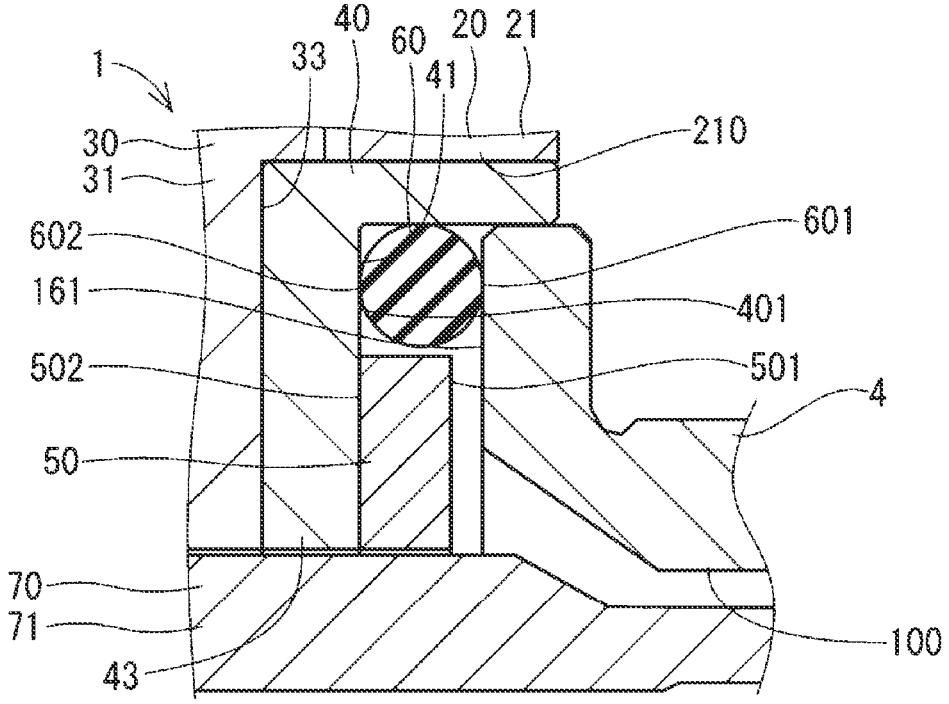
FIG. 14B is a descriptive view for describing the installation procedure of installing the valve timing regulator of the eighth embodiment to the driven shaft while indicating a state in the middle of the installation of the valve timing regulator.
Figure 14C:
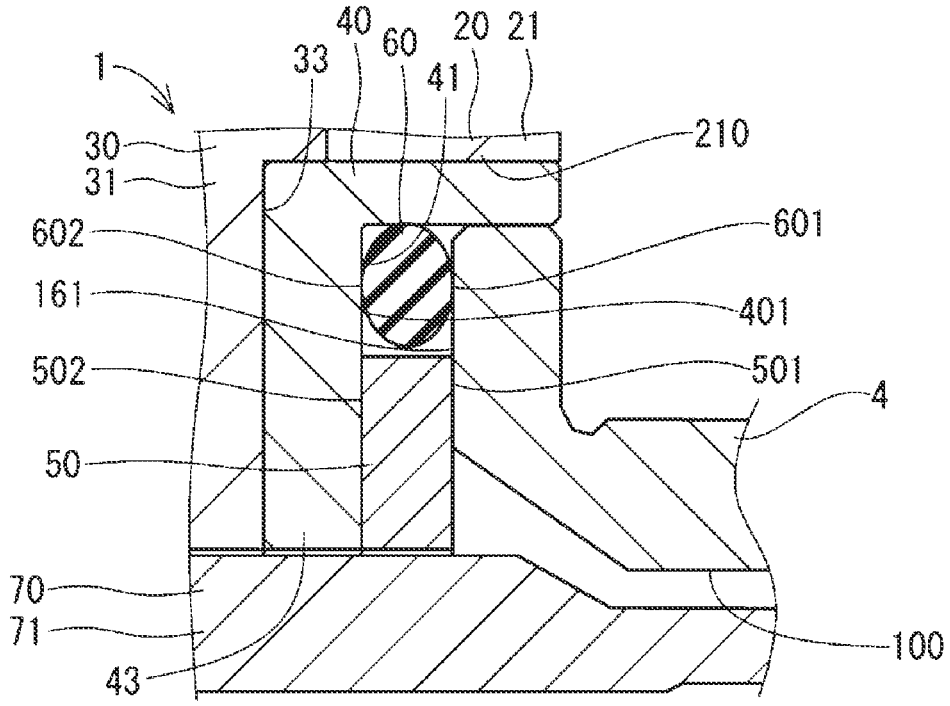
FIG. 14C is a descriptive view for describing the installation procedure of installing the valve timing regulator of the eighth embodiment to the driven shaft while indicating a state after the installation of the valve timing regulator.

FIGS. 14A, 14B and 14C respectively show a portion of a valve timing regulator according to an eighth embodiment. The eighth embodiment differs from the sixth embodiment with respect to the position of the contact member 60 in the state before the installation of the valve timing regulator 1 to the camshaft 4.

Installation of the valve timing regulator 1 of the present embodiment to the camshaft 4 will be described.

As shown in FIG. 14A, in the state before the installation of the valve timing regulator 1 to the camshaft 4, the contact member 60 is installed to the camshaft 4 such that the first member contact surface 601 of the contact member 60 contacts the shaft end surface 161. The contact member 60 is installed to the shaft end surface 161 by, for example, bonding.

Like in the sixth embodiment, the friction shim 50 is installed to the rotor 40 such that the second shim contact surface 502 of the friction shim 50 contacts the opposing surface 401.

Here, in the state where the contact member 60 is installed to the camshaft 4, a distance between the second member contact surface 602 and the shaft end surface 161 is larger than a distance between the first shim contact surface 501 and the opposing surface 401.

As shown in FIG. 14B, when the valve timing regulator 1 is brought close to the camshaft 4 in order to install the valve timing regulator 1 to the camshaft 4, the second member contact surface 602 contacts the opposing surface 401 at first. At this time, the first shim contact surface 501 does not contact the shaft end surface 161.

Then, in the state where the second member contact surface 602 contacts the opposing surface 401, a relative position between the vane rotor 30 and the camshaft 4 is adjusted (see FIG. 14B). At this time, the second member contact surface 602 and the opposing surface 401 can slide relative to each other, but the first shim contact surface 501 and the shaft end surface 161 do not slide relative to each other.

Next, the center bolt 70 is installed at the inside of the vane rotor 30, the rotor 40, the contact member 60 and the friction shim 50 and is inserted into the shaft hole 100, and the center bolt 70 is rotated to tightly couple the vane rotor 30 and the rotor 40 to the camshaft 4 (see FIG. 14B). At this time, the second member contact surface 602 and the opposing surface 401 can slide relative to each other, but the first shim contact surface 501 and the shaft end surface 161 do not slide relative to each other.

When the center bolt 70 is further rotated, the second member contact surface 602 of the contact member 60 is urged toward the camshaft 4 by the opposing surface 401, so that the contact member 60 is compressed in the axial direction (see FIG. 14C). Furthermore, at this time, the first shim contact surface 501 contacts the shaft end surface 161. The center bolt 70 is threadably inserted into the camshaft 4 such that a predetermined axial force is applied from the center bolt 70 to the vane rotor 30, the rotor 40 and the friction shim 50. Thereby, the installation of the valve timing regulator 1 to the camshaft 4 is completed.

After the installation of the valve timing regulator 1 to the camshaft 4, a frictional force is generated between the first shim contact surface 501 of the friction shim 50 and the shaft end surface 161 of the camshaft 4, and also a frictional force is generated between the second shim contact surface 502 of the friction shim 50 and the opposing surface 401 of the rotor 40. Therefore, slippage, which is caused by relative rotation of the vane rotor 30 and the rotor 40 relative to the camshaft 4, can be limited.

In the present embodiment, after the installation of the valve timing regulator 1 to the camshaft 4, the first member contact surface 601 of the contact member 60 contacts the shaft end surface 161, and the second member contact surface 602 of the contact member 60 contacts the opposing surface 401, and the contact member 60 is compressed in the axial direction of the camshaft 4 by the shaft end surface 161 and the opposing surface 401 (see FIG. 14C). Therefore, like in the sixth embodiment, the contact member 60 can reliably limit leakage of the hydraulic oil to the outside through the location between the rotor 40 and the camshaft 4.

As discussed above, in the present embodiment, the contact member 60 has the first member contact surface 601, which is configured to contact the shaft end surface 161, and the second member contact surface 602, which is configured to contact the opposing surface 401.

The contact member 60 is installed to the camshaft 4 such that the second member contact surface 602 contacts the opposing surface 401 before occurrence of contact of the first shim contact surface 501 to the shaft end surface 161 at the time of installing the valve timing regulator 1 to the camshaft 4. Therefore, at the time of installing the valve timing regulator 1 to the camshaft 4, even when the relative position of the vane rotor 30 and the rotor 40 relative to the camshaft 4 is adjusted or when the vane rotor 30 and the rotor 40 are tightly coupled to the camshaft 4 by rotating the center bolt 70, the first shim contact surface 501 of the friction shim 50 and the shaft end surface 161 do not slide relative to each other although the second member contact surface 602 of the contact member 60 and the opposing surface 401 slide relative to each other. Thereby, it is possible to limit generation of wear particles between the friction shim 50 and the camshaft 4.

As described above, according to the present embodiment, at the time of installing the valve timing regulator 1 to the camshaft 4, it is possible to limit the generation of the wear particles between the friction shim 50 and the camshaft 4, and thereby it is possible to limit mixing of the wear particles, i.e., foreign objects into the hydraulic oil to be supplied to the retard chambers 301 and the advance chambers 302 of the valve timing regulator 1. Thus, the malfunction of the valve timing regulator 1 can be limited.

In the present embodiment, the contact member 60 is shaped in the ring form. Therefore, the structure of the contact member 60 can be simplified.

Ninth Embodiment

Figure 15A:
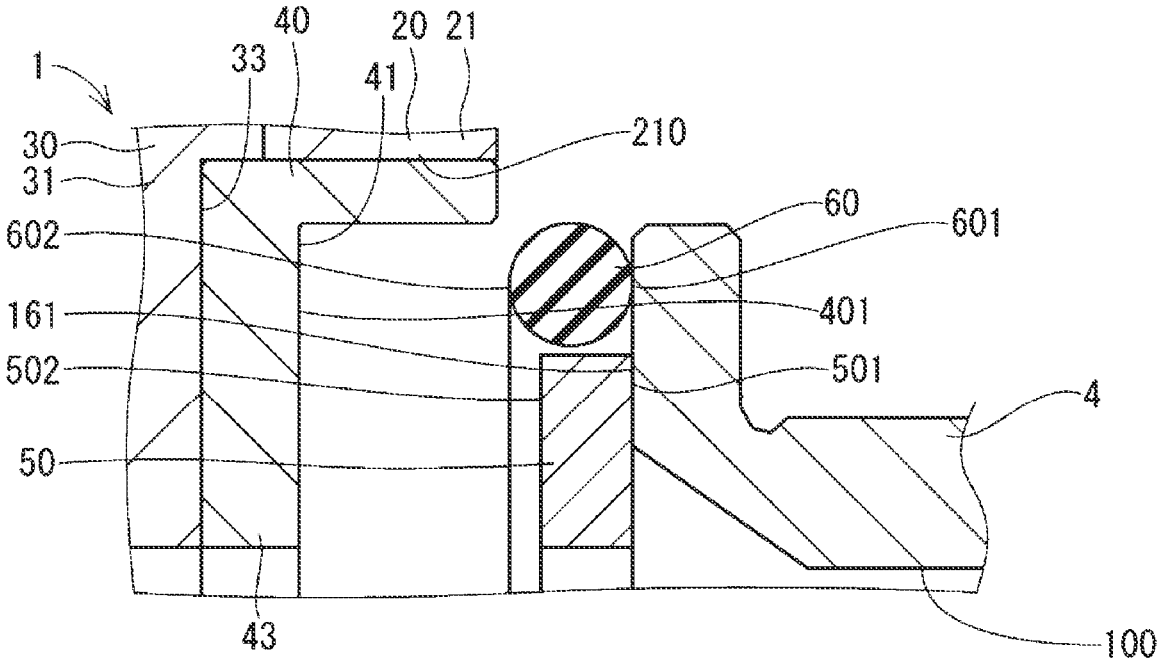
FIG. 15A is a descriptive view for describing an installation procedure of installing a valve timing regulator of a ninth embodiment to the driven shaft while indicating a state before the installation of the valve timing regulator.
Figure 15B:
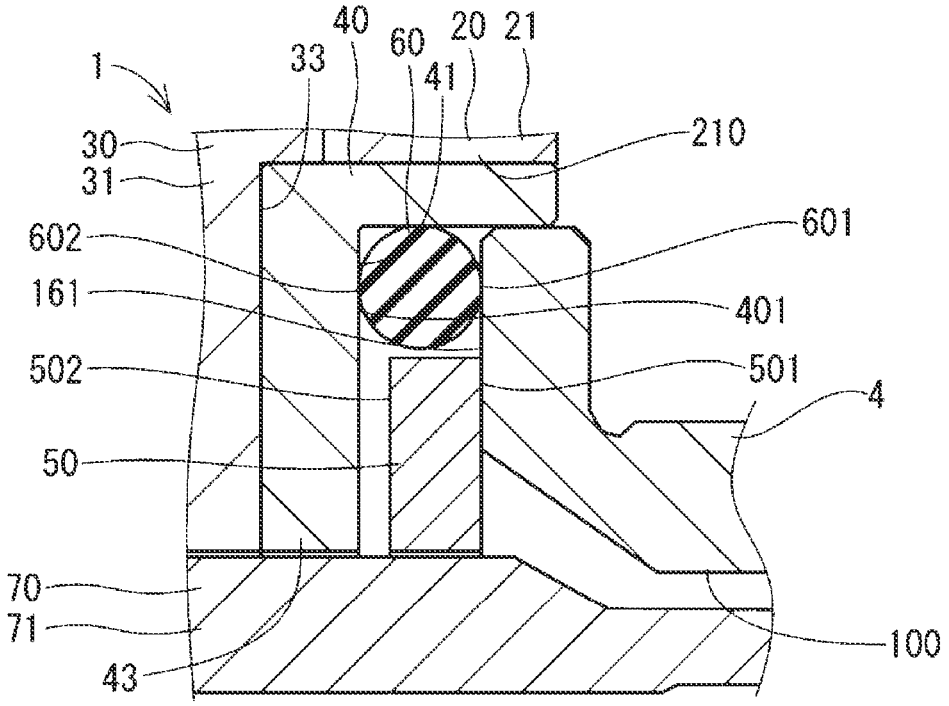
FIG. 15B is a descriptive view for describing the installation procedure of installing the valve timing regulator of the ninth embodiment to the driven shaft while indicating a state in the middle of the installation of the valve timing regulator.
Figure 15C:
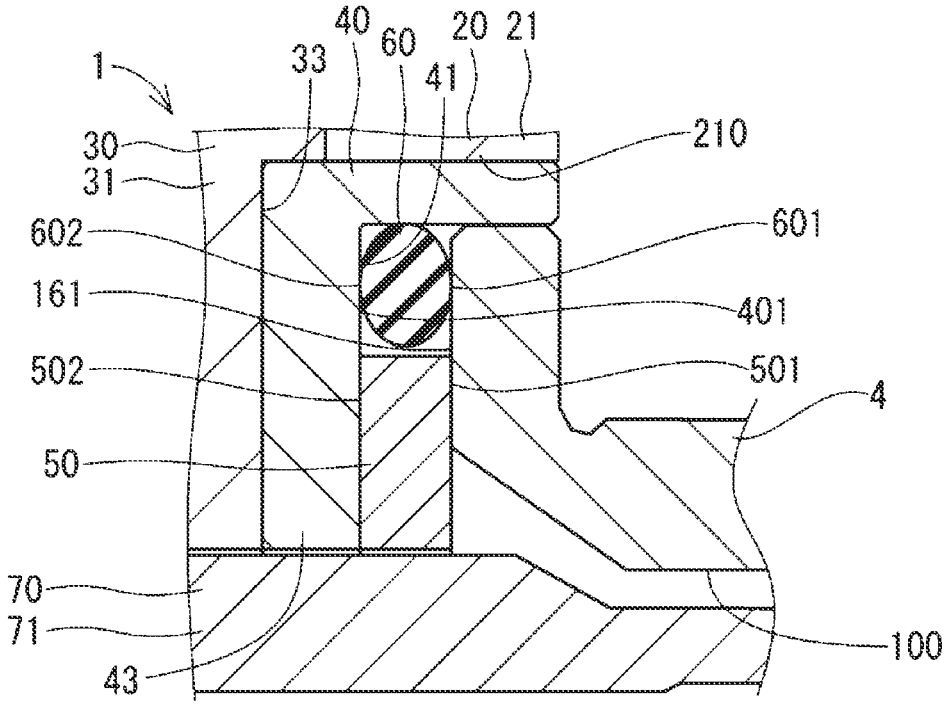
FIG. 15C is a descriptive view for describing the installation procedure of installing the valve timing regulator of the ninth embodiment to the driven shaft while indicating a state after the installation of the valve timing regulator.

FIGS. 15A, 15B and 15C respectively show a portion of a valve timing regulator according to a ninth embodiment. The ninth embodiment differs from the eighth embodiment with respect to the position of the friction shim 50 in the state before the installation of the valve timing regulator 1 to the camshaft 4.

Installation of the valve timing regulator 1 of the present embodiment to the camshaft 4 will be described.

As shown in FIG. 15A, in the state before the installation of the valve timing regulator 1 to the camshaft 4, the friction shim 50 is installed to the camshaft 4 such that the first shim contact surface 501 of the friction shim 50 contacts the shaft end surface 161. The friction shim 50 is installed to the shaft end surface 161 by, for example, bonding.

Like in the eighth embodiment, the contact member 60 is installed to the camshaft 4 such that the first member contact surface 601 of the contact member 60 contacts the shaft end surface 161. The contact member 60 is installed to the shaft end surface 161 by, for example, bonding.

In the state where the friction shim 50 and the contact member 60 are installed to the camshaft 4, the second member contact surface 602 is located on the side of the second shim contact surface 502, which is opposite to the shaft end surface 161, i.e., is located on the rotor 40 side.

As shown in FIG. 15B, when the valve timing regulator 1 is brought close to the camshaft 4 in order to install the valve timing regulator 1 to the camshaft 4, the second member contact surface 602 contacts the opposing surface 401 at first. At this time, the second shim contact surface 502 does not contact the opposing surface 401.

Then, in the state where the second member contact surface 602 contacts the opposing surface 401, a relative position between the vane rotor 30 and the camshaft 4 is adjusted (see FIG. 15B). At this time, the second member contact surface 602 and the opposing surface 401 can slide relative to each other, but the second shim contact surface 502 and the opposing surface 401 do not slide relative to each other.

Next, the center bolt 70 is installed at the inside of the vane rotor 30, the rotor 40, the contact member 60 and the friction shim 50 and is inserted into the shaft hole 100, and the center bolt 70 is rotated to tightly couple the vane rotor 30 and the rotor 40 to the camshaft 4 (see FIG. 15B). At this time, the second member contact surface 602 and the opposing surface 401 can slide relative to each other, but the second shim contact surface 502 and the opposing surface 401 do not slide relative to each other.

When the center bolt 70 is further rotated, the second member contact surface 602 of the contact member 60 is urged toward the camshaft 4 by the opposing surface 401, so that the contact member 60 is compressed in the axial direction (see FIG. 15C). Furthermore, at this time, the second shim contact surface 502 contacts the opposing surface 401. The center bolt 70 is threadably inserted into the camshaft 4 such that a predetermined axial force is applied from the center bolt 70 to the vane rotor 30, the rotor 40 and the friction shim 50. Thereby, the installation of the valve timing regulator 1 to the camshaft 4 is completed.

After the installation of the valve timing regulator 1 to the camshaft 4, a frictional force is generated between the first shim contact surface 501 of the friction shim 50 and the shaft end surface 161 of the camshaft 4, and also a frictional force is generated between the second shim contact surface 502 of the friction shim 50 and the opposing surface 401 of the rotor 40. Therefore, slippage, which is caused by relative rotation of the vane rotor 30 and the rotor 40 relative to the camshaft 4, can be limited.

In the present embodiment, after the installation of the valve timing regulator 1 to the camshaft 4, the first member contact surface 601 of the contact member 60 contacts the shaft end surface 161, and the second member contact surface 602 of the contact member 60 contacts the opposing surface 401, and the contact member 60 is compressed in the axial direction of the camshaft 4 by the shaft end surface 161 and the opposing surface 401 (see FIG. 15C). Therefore, like in the eighth embodiment, the contact member 60 can reliably limit leakage of the hydraulic oil to the outside through the location between the rotor 40 and the camshaft 4.

As described above, in the present embodiment, the contact member 60 is installed to the camshaft 4 such that the second member contact surface 602 contacts the opposing surface 401 before occurrence of contact of the second shim contact surface 502 to the opposing surface 401 at the time of installing the valve timing regulator 1 to the camshaft 4. Therefore, it is possible to limit the generation of the wear particles between the friction shim 50 and the rotor 40, and thereby it is possible to limit mixing of the wear particles, i.e., the foreign objects into the hydraulic oil to be supplied to the retard chambers 301 and the advance chambers 302. Thus, the malfunction of the valve timing regulator 1 can be limited.

Tenth Embodiment

Figure 16A:
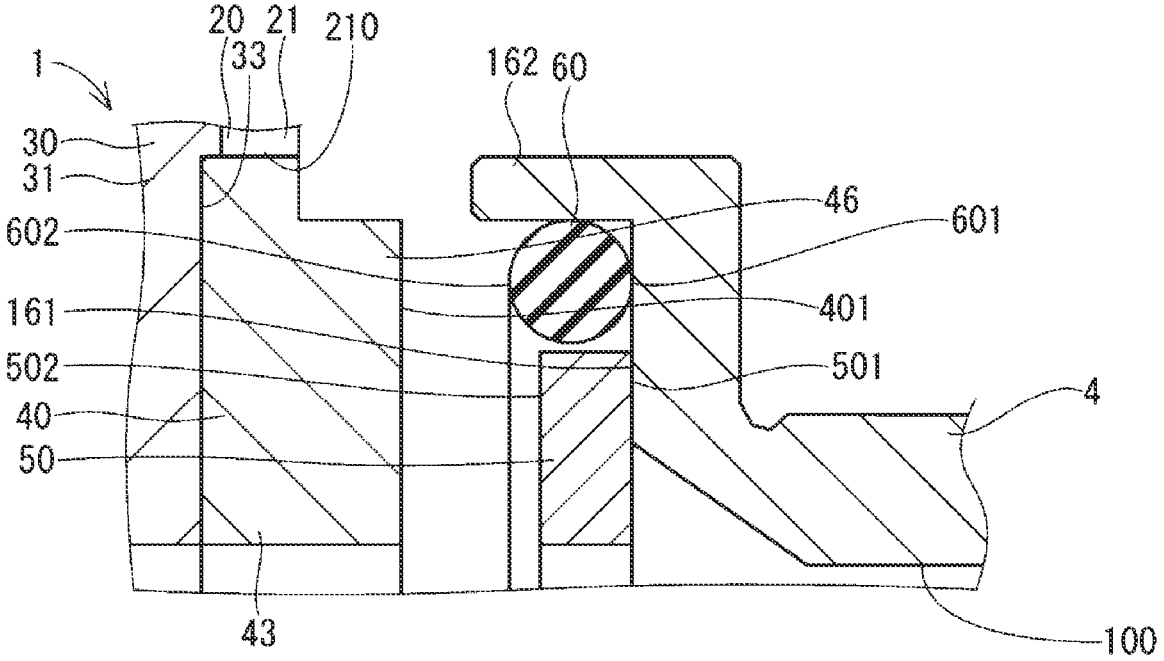
FIG. 16A is a descriptive view for describing an installation procedure of installing a valve timing regulator of a tenth embodiment to the driven shaft while indicating a state before the installation of the valve timing regulator.
Figure 16B:
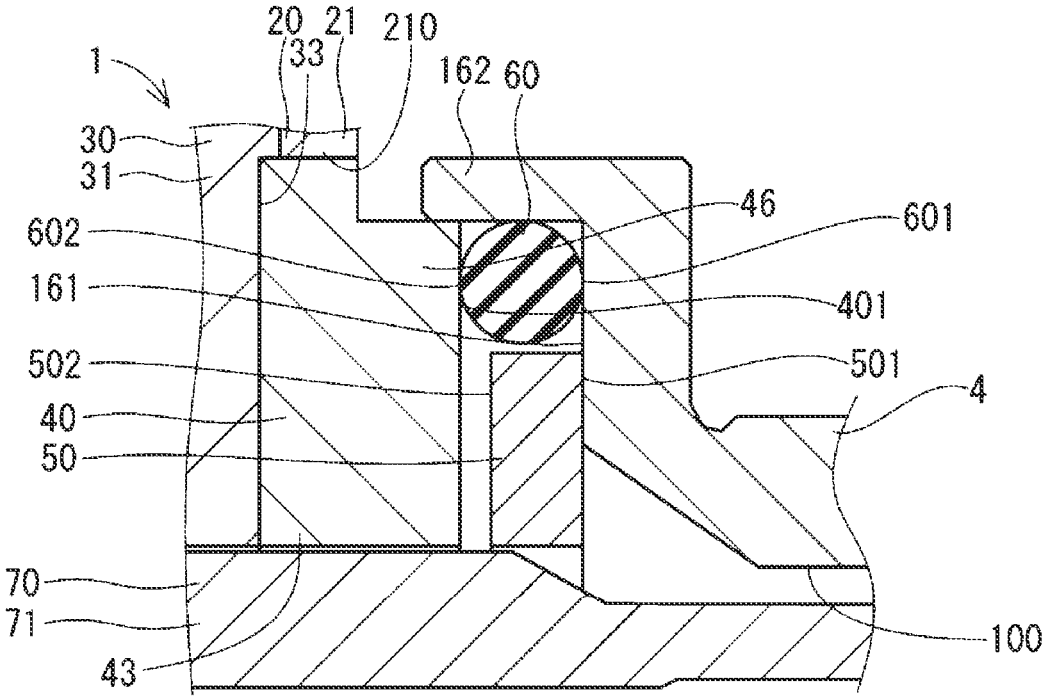
FIG. 16B is a descriptive view for describing the installation procedure of installing the valve timing regulator of the tenth embodiment to the driven shaft while indicating a state in the middle of the installation of the valve timing regulator.
Figure 16C:
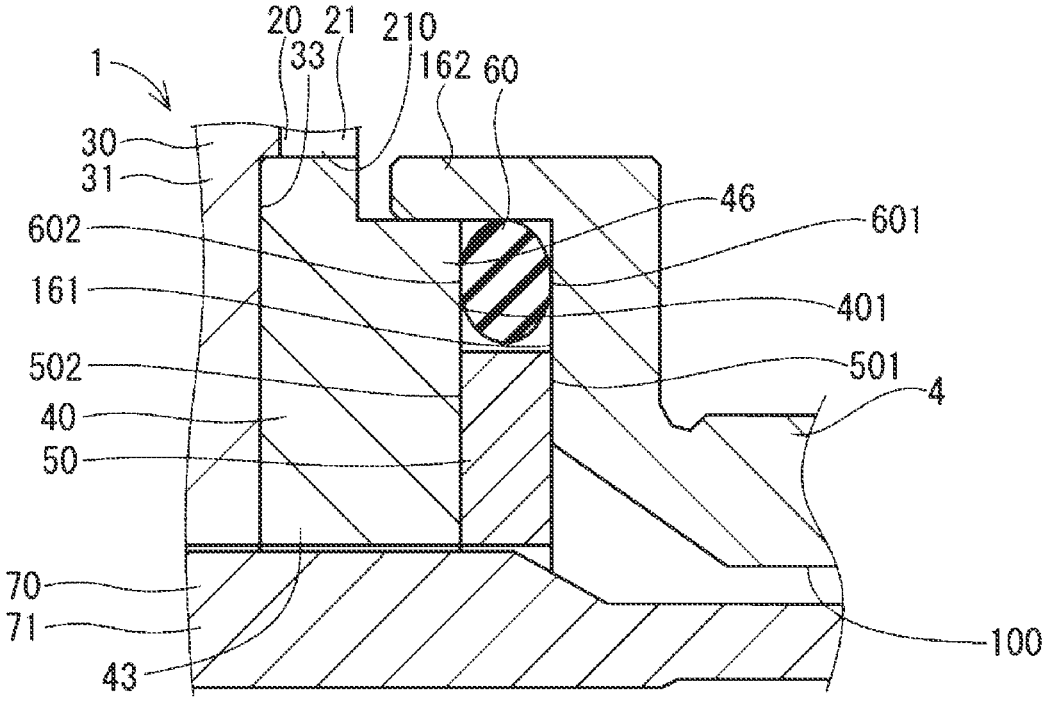
FIG. 16C is a descriptive view for describing the installation procedure of installing the valve timing regulator of the tenth embodiment to the driven shaft while indicating a state after the installation of the valve timing regulator.

FIGS. 16A, 16B and 16C respectively show a portion of a valve timing regulator according to a tenth embodiment. The tenth embodiment differs from the ninth embodiment with respect to, for example, the structures of the rotor 40 and the camshaft 4.

In the present embodiment, the rotor 40 has a projection 46 in place of the recess 41. The projection 46 is shaped generally in a circular ring form and projects from an end surface of the rotor 40, which is opposite to the vane rotor 30, toward the side that is opposite to the vane rotor 30. A surface of the projection 46, which is opposite to the vane rotor 30, has an opposing surface 401.

The camshaft 4 has a tubular portion 162, which is shaped generally in a cylindrical tubular form and projects from an outer peripheral portion of the shaft end surface 161. An inner diameter of the tubular portion 162 is slightly larger than an outer diameter of the projection 46.

Installation of the valve timing regulator 1 of the present embodiment to the camshaft 4 will be described.

As shown in FIG. 16A, in the state before the installation of the valve timing regulator 1 to the camshaft 4, the friction shim 50 is installed to the camshaft 4 such that the first shim contact surface 501 of the friction shim 50 contacts the shaft end surface 161 like in the ninth embodiment.

The contact member 60 is installed such that the contact member 60 is fitted to the tubular portion 162 of the camshaft 4. The contact member 60 is installed to the camshaft 4 such that the first member contact surface 601 of the contact member 60 contacts the shaft end surface 161, and the outer peripheral portion of the contact member 60 is engaged to an inner peripheral wall of the tubular portion 162. The outer peripheral portion of the contact member 60 serves as an engaging portion.

In the state where the friction shim 50 and the contact member 60 are installed to the camshaft 4, the second member contact surface 602 is located on the side of the second shim contact surface 502, which is opposite to the shaft end surface 161, i.e., is located on the rotor 40 side.

As shown in FIG. 16B, when the valve timing regulator 1 is brought close to the camshaft 4 in order to install the valve timing regulator 1 to the camshaft 4, the second member contact surface 602 contacts the opposing surface 401 at first. At this time, the second shim contact surface 502 does not contact the opposing surface 401.

Then, in the state where the second member contact surface 602 contacts the opposing surface 401, a relative position between the vane rotor 30 and the camshaft 4 is adjusted (see FIG. 16B). At this time, the second member contact surface 602 and the opposing surface 401 can slide relative to each other, but the second shim contact surface 502 and the opposing surface 401 do not slide relative to each other.

Next, the center bolt 70 is installed at the inside of the vane rotor 30, the rotor 40, the contact member 60 and the friction shim 50 and is inserted into the shaft hole 100, and the center bolt 70 is rotated to tightly couple the vane rotor 30 and the rotor 40 to the camshaft 4 (see FIG. 16B). At this time, the second member contact surface 602 and the opposing surface 401 can slide relative to each other, but the second shim contact surface 502 and the opposing surface 401 do not slide relative to each other.

When the center bolt 70 is further rotated, the second member contact surface 602 of the contact member 60 is urged toward the camshaft 4 by the opposing surface 401, so that the contact member 60 is compressed in the axial direction (see FIG. 16C). Furthermore, at this time, the second shim contact surface 502 contacts the opposing surface 401. The center bolt 70 is threadably inserted into the camshaft 4 such that a predetermined axial force is applied from the center bolt 70 to the vane rotor 30, the rotor 40 and the friction shim 50. Thereby, the installation of the valve timing regulator 1 to the camshaft 4 is completed.

After the installation of the valve timing regulator 1 to the camshaft 4, a frictional force is generated between the first shim contact surface 501 of the friction shim 50 and the shaft end surface 161 of the camshaft 4, and also a frictional force is generated between the second shim contact surface 502 of the friction shim 50 and the opposing surface 401 of the rotor 40. Therefore, slippage, which is caused by relative rotation of the vane rotor 30 and the rotor 40 relative to the camshaft 4, can be limited.

In the present embodiment, after the installation of the valve timing regulator 1 to the camshaft 4, the first member contact surface 601 of the contact member 60 contacts the shaft end surface 161, and the second member contact surface 602 of the contact member 60 contacts the opposing surface 401, and the contact member 60 is compressed in the axial direction of the camshaft 4 by the shaft end surface 161 and the opposing surface 401 (see FIG. 16C). Therefore, like in the ninth embodiment, the contact member 60 can reliably limit leakage of the hydraulic oil to the outside through the location between the rotor 40 and the camshaft 4.

As described above, in the present embodiment, like in the ninth embodiment, the contact member 60 is installed to the camshaft 4 such that the second member contact surface 602 contacts the opposing surface 401 before occurrence of contact of the second shim contact surface 502 to the opposing surface 401 at the time of installing the valve timing regulator 1 to the camshaft 4. Therefore, like in the ninth embodiment, it is possible to limit the generation of the wear particles between the friction shim 50 and the rotor 40, and thereby it is possible to limit mixing of the wear particles, i.e., the foreign objects into the hydraulic oil to be supplied to the retard chambers 301 and the advance chambers 302. Thus, the malfunction of the valve timing regulator 1 can be limited.

Other Embodiments

In the above embodiments, there is described the example, in which the vane rotor 30 and the rotor 40 are formed separately. Alternatively, in another embodiment, the vane rotor 30 and the rotor 40 may be formed integrally in one-piece to serve as the second rotatable body.

In the second and third embodiments, there is described the example, in which the annular gap is formed between the inner peripheral portion of the contact member 60 and the outer peripheral portion of the friction shim 50, and the friction shim 50 is bonded to the opposing surface 401. Alternatively, in another embodiment, the outer peripheral portion of the friction shim 50 may be engaged to the inner peripheral portion of the contact member 60. In this case, it is not necessary to bond the friction shim 50 to the opposing surface 401.

Furthermore, in the fourth embodiment, there is described the example, in which the contact member 60 is installed to the rotor 40 such that the outer peripheral portion and the inner peripheral portion of the contact member 60 are engaged to the groove 44. Alternatively, in another embodiment, the contact member 60 may be installed to the rotor 40 such that only one of the outer peripheral portion and the inner peripheral portion of the contact member 60 is engaged to the groove 44.

Furthermore, in the fourth embodiment, there is described the example, in which the friction shim 50 is installed to the rotor 40 such that the outer peripheral portion of the friction shim 50 is engaged to the inner peripheral wall of the recess 41 of the rotor 40. Alternatively, in another embodiment, the friction shim 50 may be installed such that the inner peripheral portion of the friction shim 50 is engaged to the outer peripheral portion of the contact member 60.

Furthermore, in the fourth embodiment, there is described the example, in which the friction shim 50 is placed on the outer side of the contact member 60. Alternatively, in another embodiment, the friction shim 50 may be placed on the inner side of the contact member 60.

The valve timing regulator of the present disclosure may be used to regulate valve timing of the exhaust valves.

As described above, the present disclosure is not necessarily limited to the above-described embodiments and may be implemented in various forms without departing from the gist thereof.

The present disclosure has been described with reference to the embodiments. However, the present disclosure should not be limited to the above embodiments and the structures thereof. The present disclosure also covers various modifications and modifications within an equivalent range. Further, various combinations and forms, and other combinations and forms including only one element, more, or less than them are also within the scope and spirit of the present disclosure.

What is claimed is:

1. A valve timing regulator configured to be installed to a driven shaft of an internal combustion engine and regulate valve timing of the internal combustion engine, comprising:

a first rotatable body that is configured to rotate synchronously with a drive shaft of the internal combustion engine;

a second rotatable body that has an opposing surface that is opposed to a shaft end surface, which is an end surface formed at an end portion of the driven shaft, wherein the second rotatable body forms a plurality of hydraulic pressure chambers between the first rotatable body and the second rotatable body, and the second rotatable body is configured to be rotated together with the driven shaft relative to the first rotatable body by hydraulic oil supplied to corresponding one or more of the plurality of hydraulic pressure chambers;

a friction shim that is placed between the opposing surface and the shaft end surface and has a first shim contact surface, which is configured to contact the shaft end surface in an axial direction of the driven shaft, and a second shim contact surface, which is configured to contact the opposing surface in the axial direction, wherein the friction shim is configured to generate a frictional force between the first shim contact surface and the shaft end surface and a frictional force between the second shim contact surface and the opposing surface in an assembled state after installation of the valve timing regulator to the driven shaft; and a contact member that has a first member contact surface configured to contact the shaft end surface in the axial direction, wherein:

an outer diameter of the end portion of the driven shaft, at which the shaft end surface is formed, is equal to or larger than an outer diameter of the friction shim that is formed integrally in one-piece;

the contact member is configured to enable relative slide movement between the first member contact surface and the shaft end surface in a plane perpendicular to the axial direction in a preassembled state where:

the contact member contacts the second rotatable body or the first rotatable body; and the first shim contact surface and the shaft end surface are spaced from each other, or the second shim contact surface and the opposing surface are spaced from each other.

2. The valve timing regulator according to claim 1, wherein:

the second rotatable body has an inner peripheral portion that is shaped in a ring form; and the contact member has a snap fit portion that is configured to be coupled to the inner peripheral portion of the second rotatable body by snap fit.

3. The valve timing regulator according to claim 1, wherein the contact member has a filter portion that is configured to capture a foreign object contained in the hydraulic oil to be supplied to the plurality of hydraulic pressure chambers.

4. The valve timing regulator according to claim 1, wherein:

the second rotatable body has a recess, which has the opposing surface at a bottom surface of the recess; and the contact member is shaped in a ring form and is installed to the second rotatable body such that an outer peripheral portion of the contact member is engaged with an inner peripheral wall of the recess.

5. The valve timing regulator according to claim 1, wherein:

the first rotatable body has an inner peripheral portion that is shaped in a ring form; and the contact member is shaped in a ring form and is installed to the first rotatable body such that an outer peripheral portion of the contact member is engaged with the inner peripheral portion of the first rotatable body.

6. The valve timing regulator according to claim 1, wherein:

the second rotatable body has a groove that is recessed from the opposing surface toward a side, which is opposite to the shaft end surface; and the contact member is shaped in a ring form and is installed to the second rotatable body such that an outer peripheral portion or an inner peripheral portion of the contact member is engaged with the groove.

7. The valve timing regulator according to claim 1, wherein:

the second rotatable body has a hole that is recessed from the opposing surface toward a side, which is opposite to the shaft end surface; and the contact member is shaped in a rod form and is installed to the second rotatable body such that an outer peripheral wall of the contact member is engaged with the hole.

8. The valve timing regulator according to claim 1, wherein the contact member is elastically deformable in the axial direction.

9. The valve timing regulator according to claim 1, wherein after occurrence of contact of the first shim contact surface to the shaft end surface or occurrence of contact of the second shim contact surface to the opposing surface, the first member contact surface is configured to contact the shaft end surface.

10. The valve timing regulator according to claim 1, wherein the shaft end surface extends along a plane that is perpendicular to the axial direction.

11. A valve timing regulator configured to be installed to a driven shaft of an internal combustion engine and regulate valve timing of the internal combustion engine, comprising:

a first rotatable body that is configured to rotate synchronously with a drive shaft of the internal combustion engine;

a second rotatable body that has an opposing surface that is opposed to a shaft end surface, which is an end surface formed at an end portion of the driven shaft, wherein the second rotatable body forms a plurality of hydraulic pressure chambers between the first rotatable body and the second rotatable body, and the second rotatable body is configured to be rotated together with the driven shaft relative to the first rotatable body by hydraulic oil supplied to corresponding one or more of the plurality of hydraulic pressure chambers;

a friction shim that is placed between the opposing surface and the shaft end surface and has a first shim contact surface, which is configured to contact the shaft end surface in an axial direction of the driven shaft, and a second shim contact surface, which is configured to contact the opposing surface in the axial direction, wherein the friction shim is configured to generate a frictional force between the first shim contact surface and the shaft end surface and a frictional force between the second shim contact surface and the opposing surface in an assembled state after installation of the valve timing regulator to the driven shaft; and a contact member that has a first member contact surface, which is configured to contact the shaft end surface in the axial direction, and a second member contact surface, which is configured to contact the opposing surface in the axial direction, wherein:

an outer diameter of the end portion of the driven shaft, at which the shaft end surface is formed, is equal to or larger than an outer diameter of the friction shim that is formed integrally in one-piece;

the contact member is configured to enable relative slide movement between the second member contact surface and the opposing surface in a plane perpendicular to the axial direction in a preassembled state where:

the contact member contacts the driven shaft; and the first shim contact surface and the shaft end surface are spaced from each other, or the second shim contact surface and the opposing surface are spaced from each other.

12. The valve timing regulator according to claim 11, wherein the contact member is shaped in a ring form.

13. The valve timing regulator according to claim 11, wherein the contact member is elastically deformable in the axial direction.

14. The valve timing regulator according to claim 11, wherein after occurrence of contact of the first shim contact surface to the shaft end surface or occurrence of contact of the second shim contact surface to the opposing surface, the second member contact surface is configured to contact the opposing surface.

15. The valve timing regulator according to claim 11, wherein the shaft end surface extends along a plane that is perpendicular to the axial direction.

16. A valve timing regulator configured to be installed to a driven shaft of an internal combustion engine and regulate valve timing of the internal combustion engine, comprising:

a first rotatable body that is configured to rotate synchronously with a drive shaft of the internal combustion engine;

a second rotatable body that has an opposing surface that is opposed to a shaft end surface, which is an end surface of the driven shaft, wherein the second rotatable body forms a plurality of hydraulic pressure chambers between the first rotatable body and the second rotatable body, and the second rotatable body is configured to be rotated together with the driven shaft relative to the first rotatable body by hydraulic oil supplied to corresponding one or more of the plurality of hydraulic pressure chambers;

a friction shim that is placed between the opposing surface and the shaft end surface and has a first shim contact surface, which is configured to contact the shaft end surface, and a second shim contact surface, which is configured to contact the opposing surface, wherein the friction shim is configured to generate a frictional force between the first shim contact surface and the shaft end surface and a frictional force between the second shim contact surface and the opposing surface after installation of the valve timing regulator to the driven shaft; and a contact member that has a first member contact surface configured to contact the shaft end surface, wherein:

the contact member is installed to the second rotatable body or the first rotatable body such that the first member contact surface contacts the shaft end surface before occurrence of contact of the first shim contact surface to the shaft end surface or occurrence of contact of the second shim contact surface to the opposing surface at a time of installing the valve timing regulator to the driven shaft;

the first rotatable body has an inner peripheral portion that is shaped in a ring form; and the contact member is shaped in a ring form and is installed to the first rotatable body such that an outer peripheral portion of the contact member is engaged with the inner peripheral portion of the first rotatable body.

* * * * *